US006004244A

United States Patent [19]

Simonson

[11] Patent Number: 6,004,244

[45] Date of Patent: Dec. 21, 1999

[54] SIMULATED HILL-CLIMBING EXERCISE APPARATUS AND METHOD OF EXERCISING

[75] Inventor: Roy Simonson, Colorado Springs, Colo.

[73] Assignee: CYBEX International, Inc., Medway, Mass.

[21] Appl. No.: 08/800,885

[22] Filed: Feb. 13, 1997

[51] Int. Cl.[6] ..... A63B 22/00; A63B 69/14

[52] U.S. Cl. ..... 482/52; 482/51

[58] Field of Search ..... 482/51, 52, 53, 482/57, 70, 79, 80

[56] References Cited

U.S. PATENT DOCUMENTS

| | | | |
|---|---|---|---|
| 5,013,031 | 5/1991 | Bull | 482/52 |
| 5,039,088 | 8/1991 | Shifferaw | 482/57 |
| 5,279,529 | 1/1994 | Eschenbach | 482/57 |
| 5,290,211 | 3/1994 | Stearns | 482/53 |
| 5,336,141 | 8/1994 | Vittone | 482/70 |
| 5,499,956 | 3/1996 | Habing et al. | 482/52 |
| 5,577,985 | 11/1996 | Miller | 482/57 |
| 5,707,320 | 1/1998 | Yu | 482/56 |
| 5,792,026 | 8/1998 | Maresh et al. | 482/57 |
| 5,795,268 | 8/1998 | Husted | 482/51 |

FOREIGN PATENT DOCUMENTS

| | | |
|---|---|---|
| 498 150 | 12/1919 | France . |
| 229 712 | 3/1910 | Germany . |
| WO 95 00209 | 1/1995 | WIPO . |
| WO 96 08292 | 3/1996 | WIPO . |

*Primary Examiner*—Stephen R. Crow

[57] ABSTRACT

An exercise apparatus is provided comprising a frame having a front and a rear. A pair of arms are pivotally mounted at one end to the rear of the frame and a pedal is mounted to the other end of each arm. The arms are linked to each other such that when the arms are aligned, the arms extend forward and down so that the pivot axes are above and behind the respective pedals. An resistance mechanism may optionally be included. In use, user positions his or her feet on the pedals and, when provided, selects a desired resistance. The user then selects a desired speed and a desired range of motion and reciprocates the arms back and forth by alternately applying a force to the pedals in accordance with the selected speed and range of motion. The arm pivot axes remain behind and below the user's hips throughout the selected range of motion.

33 Claims, 27 Drawing Sheets

136
134
10
16
20
22
14
12
18
84
96
94
86
112
132
184
80
26
110
82
98
126
50
106
90
103
104
30
114
122

10
18
12
14
80
80'
26
184
100
50
100'
30

10
12
14
80'
184
26
80
100'
50
100
30

FIG. 16C
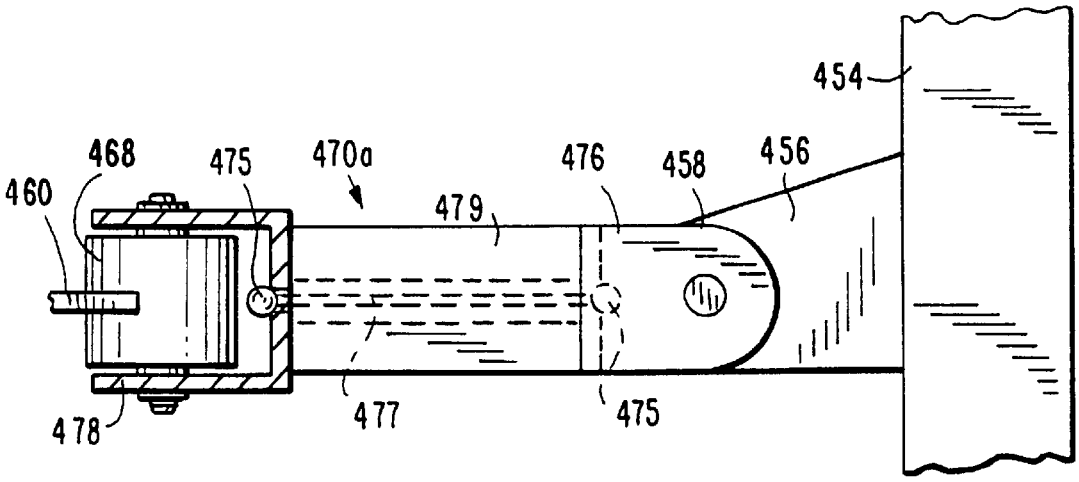
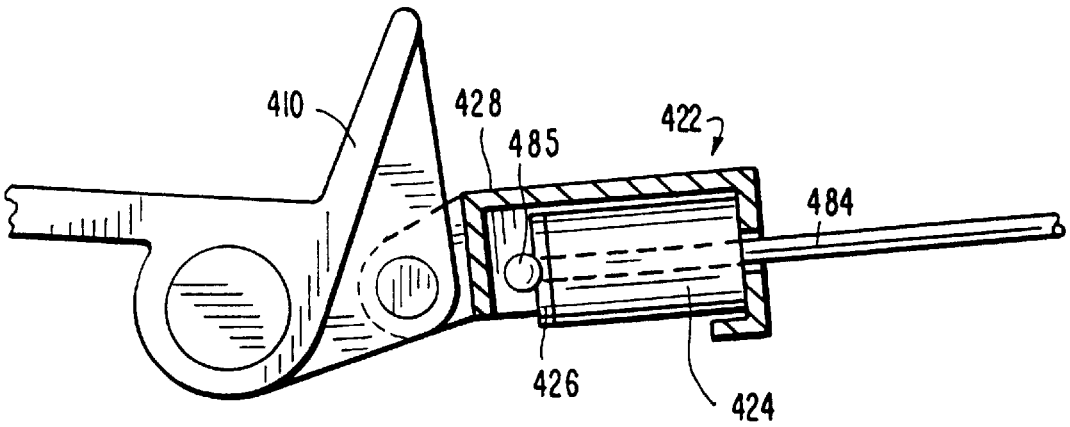
FIG. 17C

SIMULATED HILL-CLIMBING EXERCISE APPARATUS AND METHOD OF EXERCISING

FIELD OF THE INVENTION

The present invention relates to a lower body aerobic exercise and physical rehabilitation apparatus. In particular, it relates to an apparatus and method for exercising and physical rehabilitation which simulates a hill-climbing or hiking type of movement.

BACKGROUND OF INVENTION

Many lower body aerobic exercise apparatus are known in the art, including treadmills, stationary cycles, ski machines and stair steppers.

Treadmills, such as that disclosed in U.S. Pat. No. 5,484,362, typically include an endless belt supported on a platform. To use a treadmill, the user walks or runs on the belt as it is rotated along the surface of the platform. The rotation of the belt is controlled by a motor and often the incline of the platform (and the belt) may be adjusted in order to simulate walking or running uphill. The user is not, however, typically able to adjust a resistance force (other than by increasing the incline) since the belt is turned by the motor rather than by the user. Another drawback of treadmills is that the user's feet repeatedly pound down onto the belt surface thereby causing harmful stress to the user's joints, similar to that experienced when running outdoors.

Stationary cycles offer the user the option of a variable resistance through various means well known in the art. These resistance mechanisms include vaned wheel assemblies (similar to fans), flywheels in combination with a friction application device such as brake pads or a belt, and alternators which vary the resistance in response to an electrical signal. In addition, some stationary cycles may include an upper body exercise portion. One such example, disclosed in U.S. Pat. No. 4,880,225, includes a pair of handlebars pivotally connected to the frame of the cycle and operably connected to the pedals so as to reciprocate back and forth in response to, and proportionally to the pedal movement. All stationary cycles suffer from the same drawback, however, in that the leg movement is limited to the predefined circular path of the pedals.

Ski machines offer variable resistance and variable range of motion while avoiding the undesirable stress to the joints by allowing the user to simulate a cross-country skiing type motion. This is typically accomplished, as shown in U.S. Pat. No. 5,387,168, by slidably mounting a pair of foot supports to a base. Optionally, an upper body exercise apparatus may also be included. Because of the unnatural straight reciprocating movement, many users find that exercise machines of this type are awkward to use, and often require a significant learning curve. In addition, a pad or belt, such as that taught by the '168 patent, is required to stabilize the midsection of the user's body, further contributing to the awkward feel of the machine.

In recent years stair stepper type exercise machines have become particularly popular. A typical stair stepper machine, such as that disclosed in U.S. Reissue Pat. No. 34,959, includes a pair of foot pedals, each mounted to one end of a respective arm. The arms, in turn are pivotally mounted at their other ends to a stationary frame. The arms may be operably connected together so as to restrict movement to being 180° out of phase, or, as in the case of the '959 patent, may be independently moveable. In either case, various resistance mechanisms may be employed, including alternators, friction clutches or linear resistance devices such as hydraulic or pneumatic cylinders. In use, the pivot point of the arms is in front of and below the user. Accordingly, the arc defined by the pedal movement is significantly different from the natural walking motion.

SUMMARY OF THE INVENTION

It is therefore an object of the present invention to provide a lower body aerobic exercise and rehabilitation apparatus which simulates a hill-climbing or hiking type of movement.

A further object of the invention is to provide a lower body aerobic exercise apparatus which provides a selectively variable resistance.

Another object of the invention is to provide a lower body aerobic exercise apparatus which reduces impact stress on a user's joints while exercising.

Still another object of the present invention is to provide a lower body aerobic exercise apparatus which allows for variable range of motion by the user.

Yet another object of the present invention is to provide a lower body aerobic exercise apparatus which includes means for exercising the upper body of a user.

The above and other objects are achieved in accordance with a first aspect of the present invention by an exercise apparatus comprising a frame having a front and a rear. A pair of arms are pivotally mounted at one end to the rear of the frame and a pedal is mounted to the other end of each arm. The arms are linked to each other such that when the arms are aligned, the arms extend forward and down so that the pivot axes are above and behind the respective pedals. The linkage may include a resistance mechanism to provide a selectively variable resistance to the pedal movement. Alternatively, an independent resistance may be used.

In accord with another aspect of the invention, a method is provided for exercising with the above described apparatus. A user positions his or her feet on the pedals and, when provided, selects a desired resistance. The user then selects a desired speed and a desired range of motion and reciprocates the arms back and forth by alternately applying a force to the pedals in accordance with the selected speed and range of motion. The arm pivot axes remain behind and below the user's hips throughout the selected range of motion.

These and other objects, features and advantages of the present invention will be apparent and fully understood from the following detailed description of the preferred embodiments, taken in connection with the appended drawings.

BRIEF DESCRIPTION OF THE DRAWINGS

The present invention can be better understood when considered with the following drawings wherein:

FIG. 16C is a side elevational view of an intermediate link which may be used in the exercise apparatus of FIG. 16A;

FIG. 17C is a side elevational view of the cable to pedal connection of the exercise apparatus of FIG. 17A;

DETAILED DESCRIPTION

Figure 1:
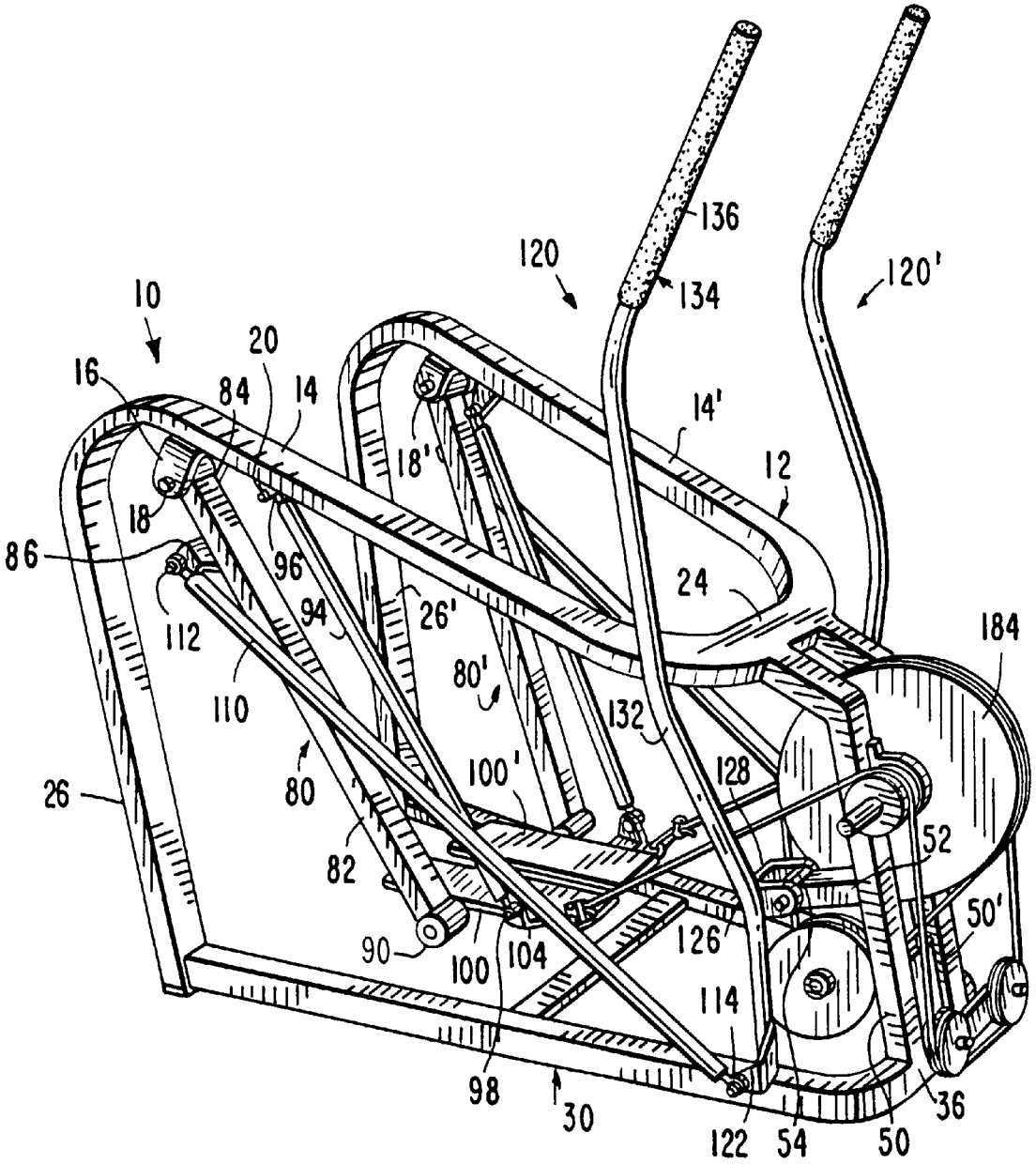
FIG. 1 is a perspective view of an embodiment of the exercise apparatus of the present invention.

Referring first to FIG. 1, a perspective view of an embodiment of the exercise apparatus of the present invention is illustrated. The exercise apparatus comprises a frame 10 which is constructed of 1½×3 inch, 11 gauge rectangular steel tubing. Unless otherwise noted, the structural components of the machine are a mild steel.

The frame 10 includes a U-shaped top beam 12 which has its ends bent downward to form rear beam portions 26 and 26'. The ends of the rear beam portions 26/26' are secured, preferably by welding, to the ends of base 30 which is also U-shaped. Two front beams 50 and 50' connect the front portion 24 of the top beam 12 to the front portion 36 of the base 30. Optionally, the base 30 may be omitted, in which case the rear beam portions 26/26' and the front beams 50/50' form legs which rest directly on the floor. (Throughout this description, references to one side of a particular embodiment should be understood to describe the structure and function of the other side, indicated by prime numbers, as well, unless otherwise noted).

Figure 2A:
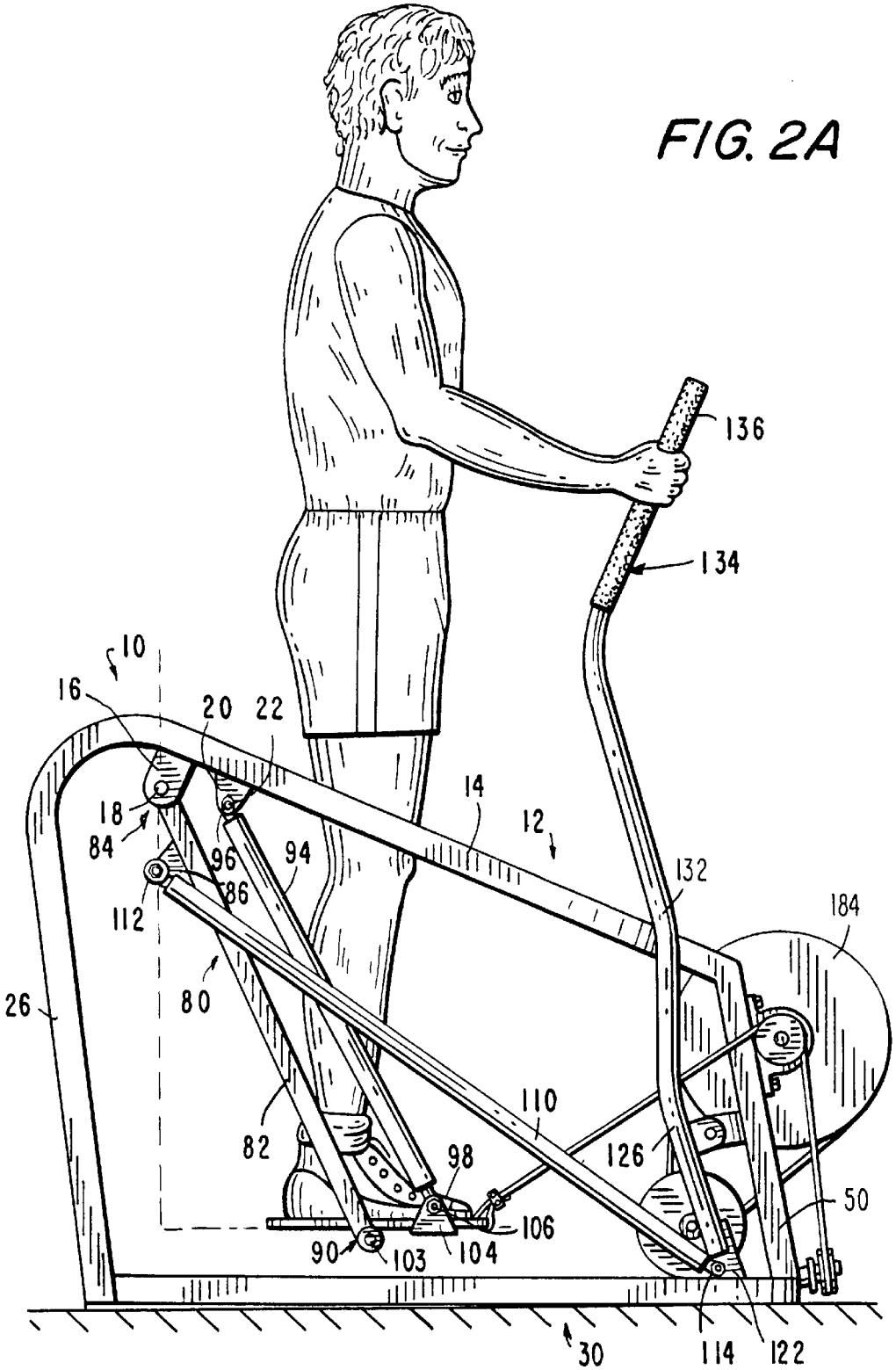
FIG. 2A is a side elevational view of a user on the exercise apparatus of FIG. 1 with the pedals in the neutral position.

The exercise apparatus of the present invention also includes two arms 80 and 80' which are pivotally mounted to the side portions 14 and 14' of the top beam 12 at their first ends and are pivotally mounted to the respective pedals 100 and 100' at their second ends. The arms 80/80' are linked together so as to reciprocate 180° out of phase with each other. Also, the arms 80/80' are linked together so that when in the neutral position, the pedals 100/100' are disposed in front of and below the pivot axes 18/18' of the arms 80/80' about the frame 10 (FIG. 2A). The connection between the two arms 80/80' may include a soft link (for example, cable(s), chain(s), belt(s) or similar tether assemblies) or it may include a hard link (for example, a bell crank).

For the purposes of this description, the neutral position is the position where the arms 80/80' are aligned with each other. Specifically, as the arms 80/80' reciprocate back and forth 180° out of phase (due to the linkage described below), they pass through a point in which the pedals 100/100' are disposed laterally adjacent to one another (FIG. 2A). This orientation is understood to be the neutral position.

Figure 2B:
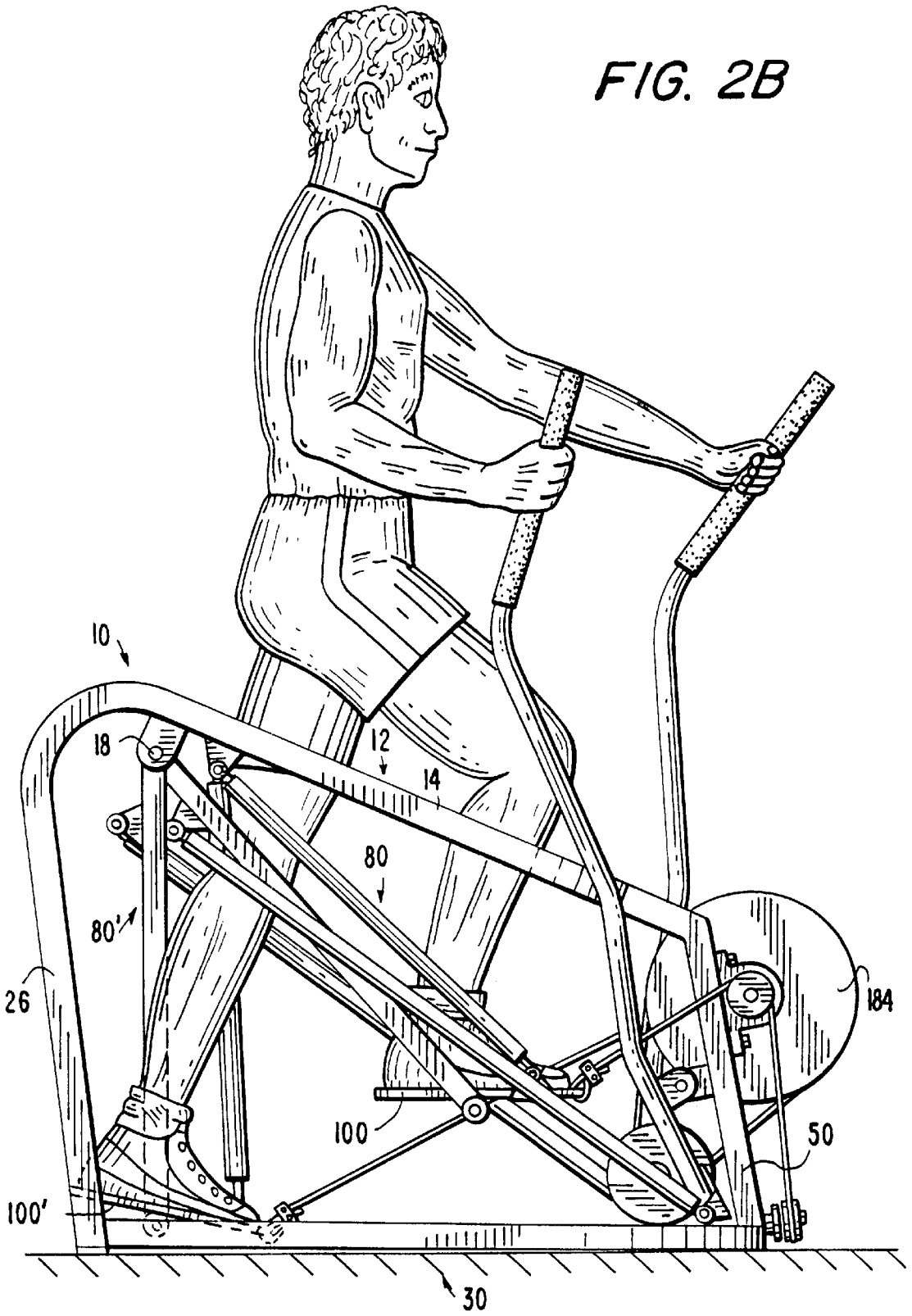
FIG. 2B is a side elevational view of a user on the exercise apparatus of FIG. 1 with the right pedal in the forward position.
Figure 2C:
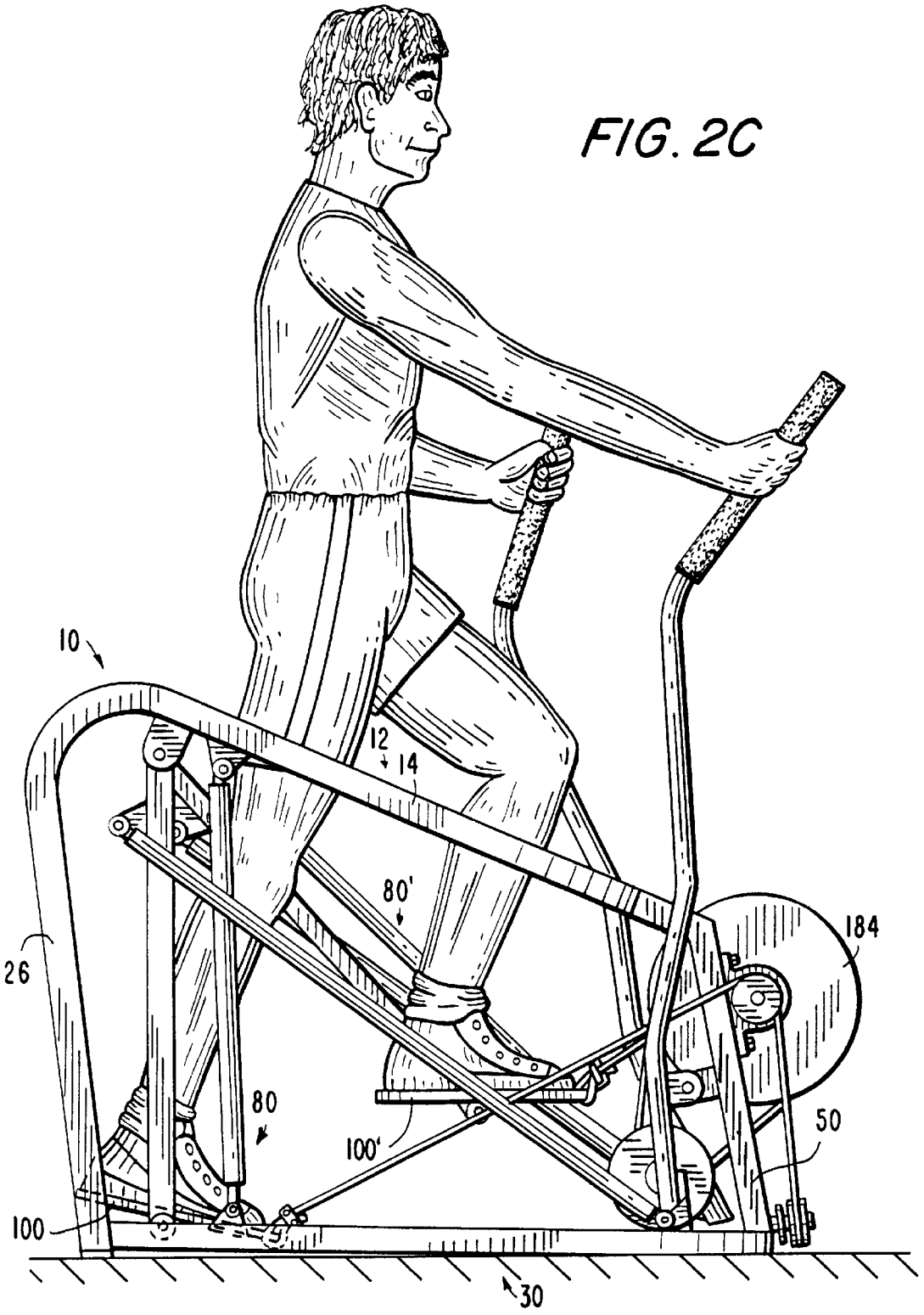
FIG. 2C is a side elevational view of a user on the exercise apparatus of FIG. 1 with the right pedal in the back position.
Figure 2D:
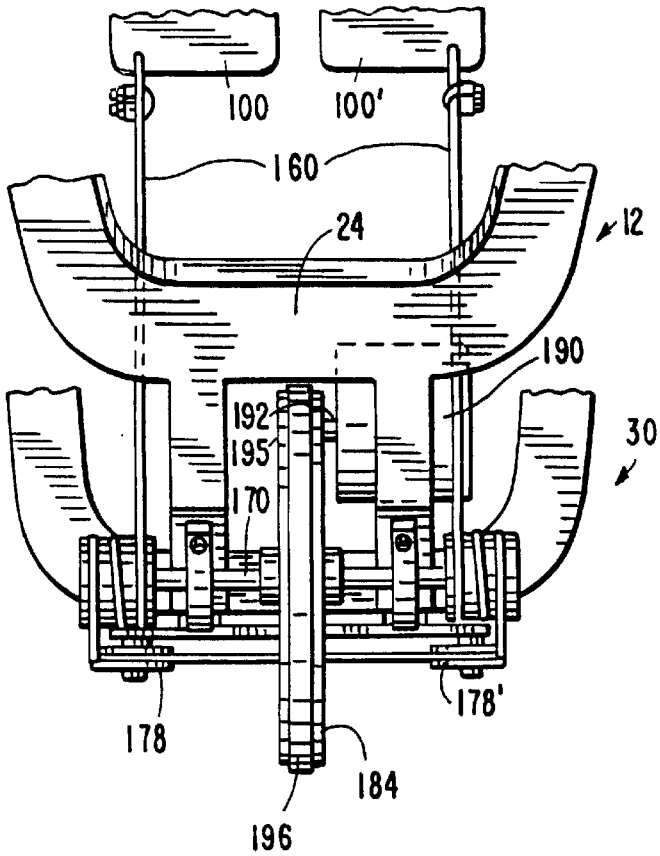
FIG. 2D is a plan view of the linkage and resistance mechanisms of the exercise apparatus of FIG. 1.

As best seen in FIGS. 2A–2C, the arms 80/80' define the movement of the pedals 100/100'. Thus, as the arm 80 is moved forward from the neutral position (FIG. 2A) to the forward position (FIG. 2B), the pedal 100 moves forward and upward, but remains below the level of the arm pivot point 18. Conversely, as the arm 80 is rotated back to the rear position (FIG. 2C), the pedal 100 moves back and down. If the user rotates the arm 80 far enough back, the arm 80 will pass through the lower most point of its arc of rotation, and consequently, the pedal 100 may begin to move up slightly. However, in normal operation the pivot point 18 of the arm 80 remains below and behind the user's hip throughout the range of motion.

The pedals 100/100' of the present invention are plates, each being large enough to accommodate the foot of a user.

Preferably, the top surface of the pedals 100/100' are textured, or are covered with a non-skid material, to prevent a user's foot from sliding off during normal use. The pedals 100/100' are spaced apart so as to follow the natural stride of a user through the movement of the pedals 100/100'. This spacing can be achieved by making the pedals 100/100' sufficiently wide or by angling the arms 80/80' laterally in slightly from the frame 10. In the embodiment of FIG. 1, the lateral centers of the pedals 100/100' are approximately 8 inches apart in the neutral position. The arms 80/80' are angled in towards the lateral center of the machine at approximately 11° from vertical as they extend down when in the neutral position, with 0° being straight down.

As illustrated in FIG. 1, each arm 80/80' may comprise a four bar linkage in order to control the orientation of the corresponding pedal 100/100' throughout the rotation of the arm 80/80'. In the illustrated embodiment, arm 80 includes a main link 82 which has bearing tubes 84, 90 mounted at either end. The top bearing tube 84 is pivotally mounted to a bracket 16 by sealed bearings, such as model #6205 metric bearings manufactured by SST, Loveland, Ohio, or an equivalent. In turn, the bracket 16 is fixed, preferably by welding, to the side portions 14 of the top beam 12, near the rear of the machine. The bottom bearing tube 90 is similarly mounted to a pedal mounting post 102 by sealed bearings, such as model #6203 metric bearings manufactured by SST, or an equivalent, the pedal mounting post 102 being welded to the underside of the corresponding pedal 100.

A secondary link 94 is also pivotally mounted between the frame 10 and the pedal 100, thereby completing the four bar linkage. The four bar linkage includes as elements side portion 14 of the top beam 12, main link 82, pedal 100 and secondary link 94. The secondary link 94 has eyelets 96, 98 mounted at either end. The top eyelet 96 is pivotally mounted to a flange 20 by a spherical rod end bearing, such as model #HM-6 manufactured by Heim, Fairfield, Conn. In turn, the flange 20 is fixed to the side portion 14 of the top beam 12, in front of the main link 82. The bottom eyelet 98 is likewise pivotally mounted to a flange 104 by a spherical rod end bearing, such as model #HM-6 manufactured by Heim. The flange 104 is fixed to the corresponding pedal 100 in front of the main link 82.

Because the dimensions of the links of the four bar linkages control the change in orientation of the pedals 100/100' as the arms 80/80' rotate, the length of the main links 82/82' and secondary links 94/94', as well as the distance between their respective pivot points must be selected carefully. In one embodiment, best seen in FIG. 2A, main link 82 is approximately 29½ inches long and secondary link 94 is approximately 28 inches long. The distance between the main link/frame pivot axis 18 and the secondary link/frame pivot axis 22 is approximately 3⅞ inches, while the distance between the main link/pedal pivot axis 103 and the secondary link/pedal pivot axis 106 is approximately 4⁷⁄₁₆ inches.

It has been found that the above configuration results in a very desirable motion. Pedal 100 is angled down in front at approximately 17°–20° from horizontal when the arm 80 is rotated to its rear position (FIG. 2C), i.e., when the main link 82 is straight down, and the pedal 100 is angled up in front at approximately 1°–5° from horizontal when the arm 80 is rotated to its forward position (FIG. 2B), i.e., when the main link 82 is at 55° from vertical, with 0° being straight down. When the arm 80 is in the neutral position (FIG. 2A), i.e., when the main link 82 is at 25° from vertical, the pedal 100 is angled down in front at approximately 0°–5° from horizontal.

Figure 2E:
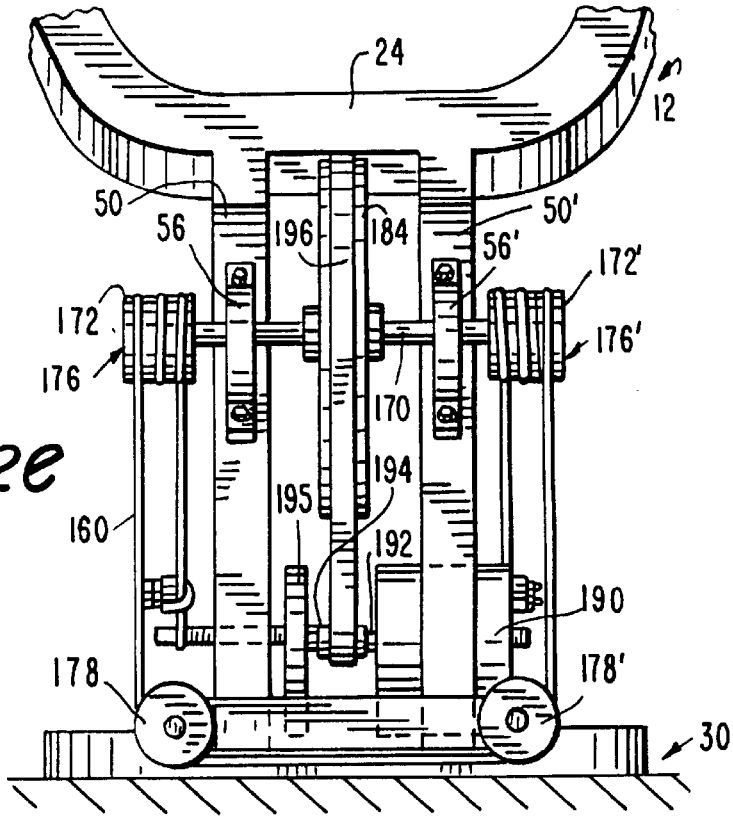
FIG. 2E is a front elevational view of the linkage and resistance mechanisms of the exercise apparatus of FIG. 1.

The exercise apparatus of the present invention may optionally include an upper body exercise attachment. As illustrated in FIGS. 1–2E, the upper body attachment includes two handles 120 and 120' which are pivotally attached to the frame 10 and operably engaged to the respective pedals 100 and 100' so as to reciprocate back and forth 180° out of phase with the pedal movement. Referring to FIG. 1, a handle support post 52 is mounted to front beam 50 and extends towards the rear of the machine. Mounted to the end of post 52, distal to the front beam 50, is a handle bearing tube 54. A bracket 128 is pivotally mounted to the handle bearing tube 54 by sealed bearings, such as model #6208 metric bearings manufactured by SST. The bracket 128, in turn, is mounted to the handle 120, preferably by welding, at a point intermediate its two ends.

As best seen in FIGS. 1 and 2A, each handle 120/120' is curved at various points. This allows the handles 120/120' to reciprocate back and forth without interference from the frame 10, while simultaneously providing convenient mounting of the handles 120/120' and allowing the user to easily grasp the handles 120/120'. Accordingly, the portion 126 of the handle 120 to which the mounting bracket 128 is fixed is curved inwardly slightly towards the lateral center of the machine. Moving up the handle 120, the next section 132 is curved outwardly slightly in order to clear the side portion 14 of the top beam 12 throughout the range of handle movement. The top portion 134 of the handle 120, which the user holds on to, is straight and may include a padded grip 136 to provide a comfortable surface for the user to grasp.

The lower end of the handle 120 is flared outwardly and includes flange 122. A handle link 110 is pivotally connected between the flange 122 and a similar flange 86 mounted on the main link 82 of the respective arm 80. More specifically, the ends of the handle link 110 include bearing tubes 112, 114 which are connected to the flanges 86, 122 by sealed bearings, such as model #6205 metric bearings manufactured by SST.

Referring again to FIGS. 2A–2C, when the pedal 100, to which the handle 120 is connected, is in the neutral position (FIG. 2A), the handle 120 is approximately vertical. As the pedal 100 is moved toward the forward position (FIG. 2B), the top portion 134 of the handle 120 is urged backward, and conversely, as the pedal 100 is moved toward the rear position (FIG. 2C), the top portion 134 of the handle 120 is urged forward. Thus, the handles 120/120' follow the natural tendency of a person's arms to reciprocate 180° out of phase with the movement of the corresponding legs. In addition, the handles 120/120' move a distance proportional to the stride of the user.

To change the relationship of the movement of the handles 120/120' to the movement of the arms 80/80', the mounting points of the handle links 110/110' to the arms 80/80' may be altered. For example, moving the connector flange 86 closer to the pedal 100 would result in greater handle 120 movement for the same amount of arm 80 movement, while moving the connector flange 86 further away from the pedal 100 would have the opposite effect. Alternatively, the mounting point of the handle 120 to the frame 10 or of the handle link 110 to the handle 120 may be altered.

The present invention may also include a mechanism to resist the movement of the arms 80/80'. This resistance mechanism may incorporate the pedal linking mechanism or it may be independent from it. In either case, many such resistance mechanisms are known in the art, and the examples given below are for illustrative purposes only.

In the embodiment shown in FIGS. 1–2E, a soft linkage is used in conjunction with an alternator type resistance. As best seen in FIGS. 2D and 2E, a shaft 170 is mounted to the front beams 50/50' by bearings 56/56'. A drive pulley 184 is fixed to the shaft 170 so as to rotate with it. On either side of the drive pulley 184, helical groove pulleys 172 and 172' are mounted to the shaft 170 by one-way clutches 176 and 176'. Each one-way clutch 176/176' engages the corresponding helical pulley 172/172' to the shaft 170 when the pulley 172/172' is rotated in one direction, but disengages the helical pulley 172/172' from the shaft 170, and allows the shaft 170 to rotate freely, when the pulley 172/172' is rotated in the opposite direction with respect to the shaft 170. Many such one-way clutches are available, one acceptable example being a roller-type one-way clutch, such as model #FCB manufactured by Torrington, Torrington, Conn.

In this embodiment, a single cable 160 is used to link the pedals 100/100' together (i.e., a soft link) and to connect the pedals 100/100' to the resistance. Each end of the cable 160 is secured to one of the two pedals 100/100'. The cable 160 extends from each pedal 100/100' to a corresponding one of the helical pulleys 172/172'. The cable 160 is wrapped around each helical pulley 172/172' at least once such that when one of the pedals, for example, pedal 100 is moved backward, the corresponding one-way clutch 176 engages the pulley 172 to the shaft 170, thereby driving the shaft 170. The one-way clutches 176/176' are oriented in the same direction so that both pedals 100/100' drive the shaft 170 in the same direction. The center portion of the cable 160 is journaled around cable return pulleys 178 and 178' which are mounted to the frame 10 so as to guide the cable 160 around the drive pulley 184.

The arms 80/80' are, therefore, "soft" linked by the cable 160. When one arm, for example, arm 80 is driven back by a user applying force to the attached pedal 100, the cable 160 pulls the corresponding helical pulley 172 in the drive direction and the one-way clutch 176 engages the pulley 172 to the shaft 170, thereby driving the shaft 170. At the same time, the cable 160, journaled around the cable return pulleys 178/178', pulls the other helical pulley 172' in the return (i.e., non-driving) direction and is allowed to spin freely by its one-way clutch 176'. The opposite arm 80' is simultaneously pulled forward by the cable 160 an equal, but opposite, distance as the driven arm 80 was moved back. When the non-driven arm 80' reaches the desired forward most position, the user reverses the application of force, urging the previously non-driven arm 80' back while allowing the other arm 80 to return to the forward position. It should be noted that while the disclosed embodiments are described in terms of a cable 160 used for the soft linkage, other tether means may be employed, such as belts, chains or the like. In addition, it should be apparent that the cable 160 (or other tether means) may be connected to other parts of the pedals 100/100' or it may be connected directly to the arms 80/80' and still practice the current invention.

To provide resistance to the rotation of the shaft 170, an alternator 190 is mounted to the frame proximate to the drive pulley 184. A pulley 194 mounted to the alternator drive shaft 192 is aligned with, and connected to the drive pulley 184 by a drive belt 196. Accordingly, the alternator 190 is coupled to the shaft 170 and rotates with it. The alternator 190 operates as a dynamic brake and is thereby able to provide controllable resistance to the rotation of the shaft 170, as is well known in the art.

One acceptable alternator resistance mechanism is a Leece-Neville system manufactured by Prestolite Electric, Toledo, Ohio, using a model no. 8ALZ109FAS alternator. In this system, a standard automotive type alternator is coupled to control circuitry and a resistor. When driven, the alternator produces a DC current which is used to power the control circuitry. Excess power is fed to the resistor which dissipates the generated current in the form of heat.

Using the control circuitry, the user can manually select the resistance level (manual mode) or may optionally select a preprogrammed exercise program (automatic mode). Such a program may include a constant resistance level over a set period of time or one that changes, either according to a set program or randomly. In either mode, as the load on the alternator is increased, the alternator is called upon to produce more current. This creates an increased drag on the alternator which requires greater effort from the user to overcome.

The alternator 190 also has a flywheel 195 mounted to the drive shaft 192 distal from the alternator 190. The flywheel 195 allows the resistance mechanism, i.e., the alternator, to maintain its rotational speed at a point where the linkage is either changing direction or has minimal force applied to it. This results in a smoother feel to the user as they do not have to build up speed at the start of each stroke, thereby providing a more constant foot speed through the leg stroke to simulate an actual walking or hiking motion.

In operation, a user first positions a foot on each pedal 100/100' and grasps the handles 120/120'. The user then begins reciprocating his feet back and forth, and adjusts the desired resistance using the alternator controls. As pedal 100 is driven back by the user's foot, the corresponding handle 120 is urged forward. Conversely, when the pedal 100 travels forward, the corresponding handle 120 is urged back, thereby exercising the user's upper body. The user may select a short stride, only displacing his feet a short distance forward and back, or the user may select a longer stride by displacing his feet a greater distance. In either case, the movement of the pedals 100/100' is equal in distance but 180° out of phase with each other due to the cable linkage, and the speed of the pedal movement is controlled by the user, limited only by the resistance of the alternator 190. Likewise, the speed and range of motion of the handles 120/120' is directly proportional to that of the pedals 100/100', regardless of the stride length or speed selected. Also, as stated above, in normal operation the pivot points 18/18' of the arms 80/80' remain below and behind the user's hips throughout the range of motion.

Figure 3A:
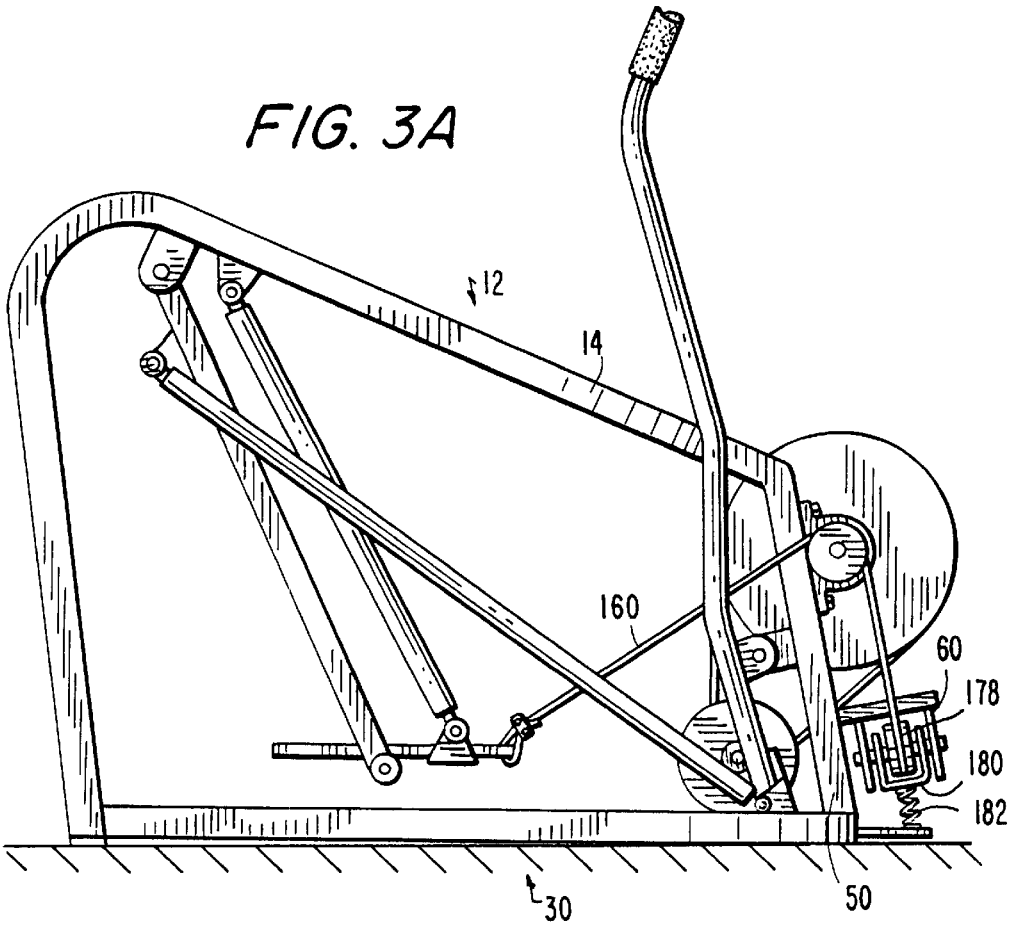
FIG. 3A is a side elevational view of another embodiment of the exercise apparatus of the present invention having an alternator resistance and tether linkage with tensioning.
Figure 3B:
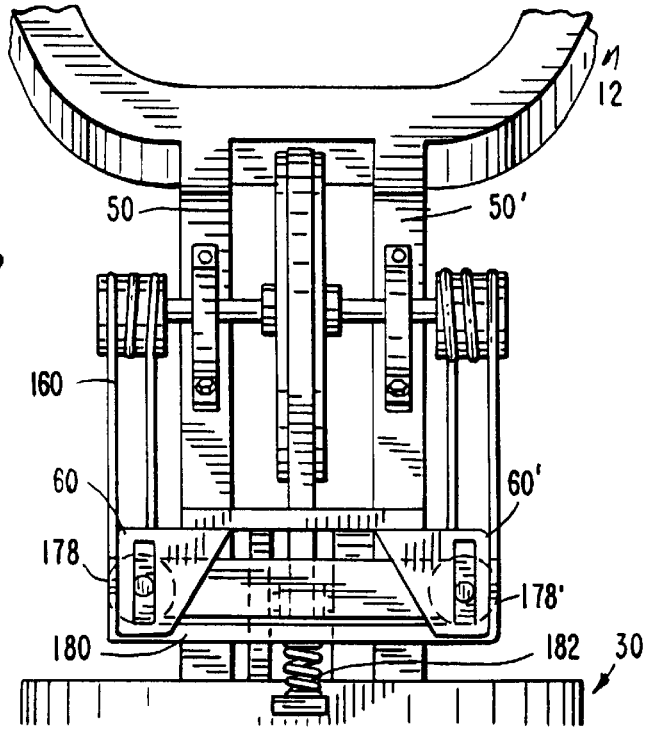
FIG. 3B is a front elevational view of the linkage and resistance mechanisms of the exercise apparatus of FIG. 3A.

FIGS. 3A and 3B show an alternate embodiment of the present invention. This embodiment is identical to the embodiment of FIGS. 1–2E except this embodiment includes a cable tensioning mechanism. More specifically, rather than mounting the cable return pulleys 178/178' in fixed relation to the frame as in the previous embodiment, they are mounted to a pulley carriage 180. The pulley carriage 180, in turn, is secured to the frame 10 by a biasing element, such as spring 182. A pair of pulley stops 60/60' are also mounted to the frame 10 and are disposed to limit the travel of the pulley carriage 180 as the spring 182 is elongated.

The spring 182 operates to maintain constant tension on the cable 160, thereby preventing the cable 160 from becoming disengaged from one of the pulleys. When a user steps on the pedals 100/100', the cable 160 pulls on the pulley carriage 180 and elongates the spring 182 until the pulley carriage 180 engages the pulley stops 60/60'. If, at any time, there is a reason for the cable 160 to go slack, the spring 182 contracts to take up the extra cable 160 and maintain tension on the cable, thereby preventing it from possibly "jumping" one of the pulleys.

Figure 4A:
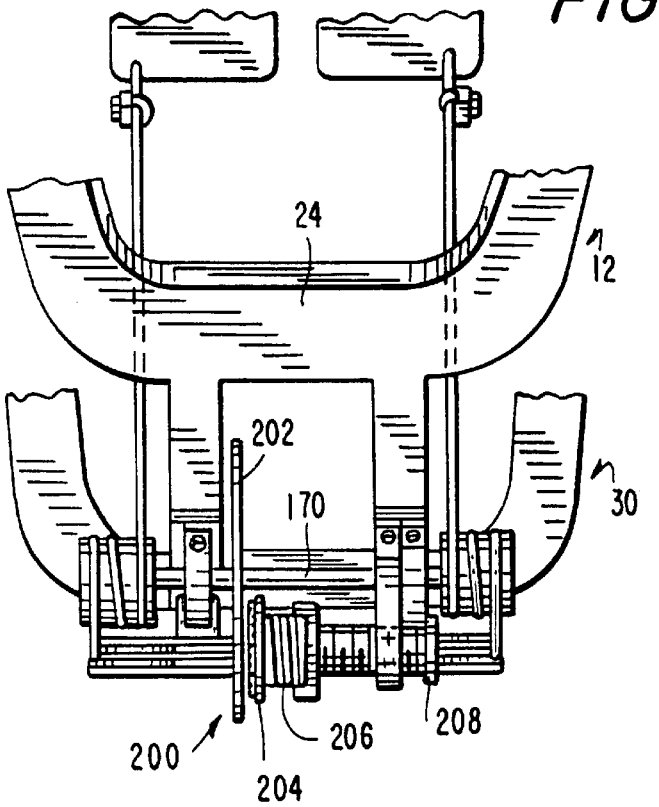
FIG. 4A is a side elevational view of the exercise apparatus of FIG. 1 having a friction clutch resistance.
Figure 4B:
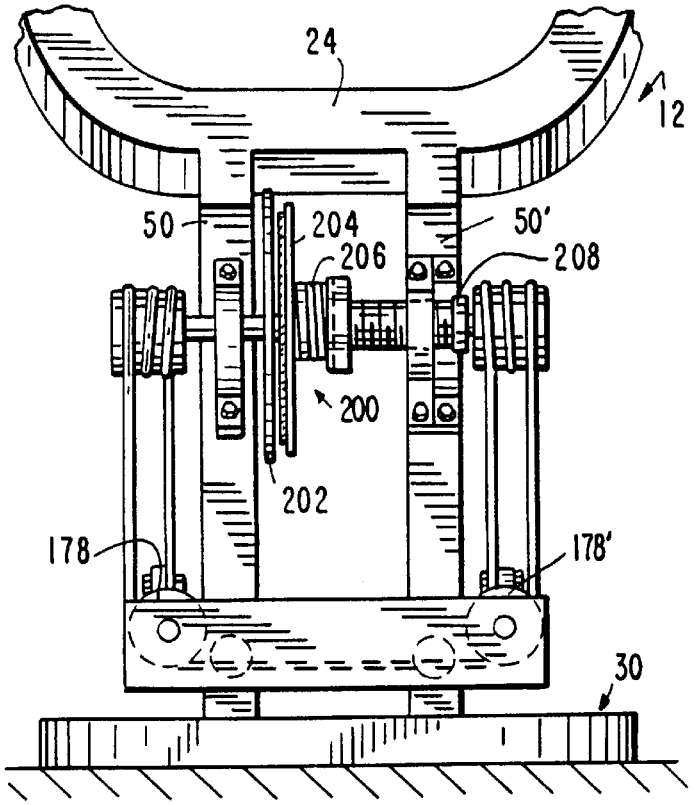
FIG. 4B is a front elevational view of the linkage and resistance mechanisms of the exercise apparatus of FIG. 4A.

FIGS. 4A and 4B show a third embodiment of the present invention which is identical to the first embodiment (FIGS.

1–2E) except that the alternator resistance has been replaced by a friction clutch 200. The friction clutch 200 includes a disk 202 which is mounted to the shaft 170 in place of the drive pulley 184 and rotates with the shaft 170. The resistance of the friction clutch 200 is adjusted by a user turning a knob 208 that in turn actuates a spring 206. The spring presses a friction pad 204 against the disk 202. The clutch pressure, and hence the resistance, is adjusted by the degree of turn on the knob 208, as is well known in the art. Thus, it is apparent that this embodiment would be operated by a user in an identical manner as the previous embodiments, but the resistance would be selected by adjusting the friction clutch 200, rather than adjusting the alternator 190 resistance.

It should be noted that alternate frictional type resistance mechanisms known in the art could be substituted for the frictional clutch 200. One example of an alternate frictional resistance mechanism includes a flywheel with adjustable brake pads as is used on many stationary exercise cycles. Likewise, a friction belt riding on a flat outer perimeter of a flywheel could also be substituted for the friction clutch 200.

Figure 5A:
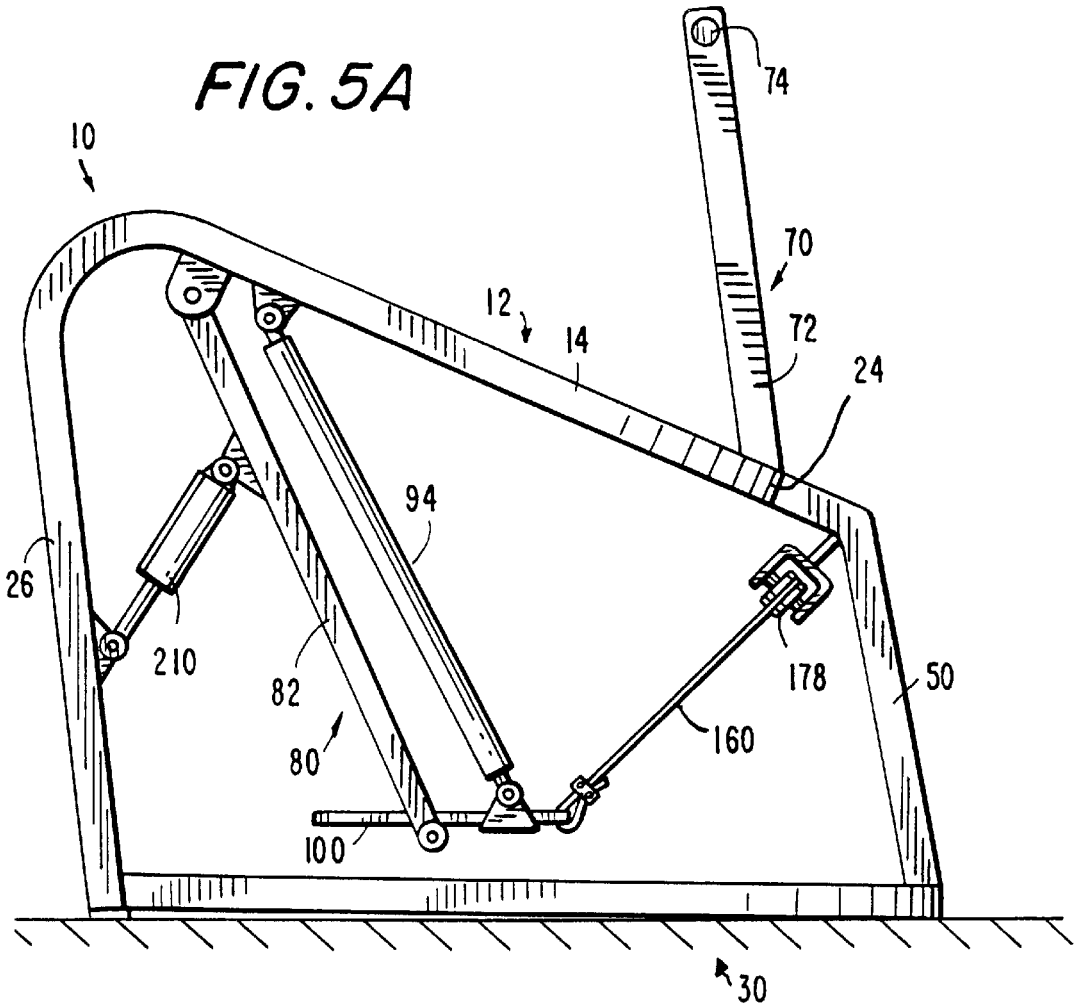
FIG. 5A is a side elevational view of another embodiment of the exercise apparatus of the present invention having a linear resistance and tether linkage.
Figure 5B:
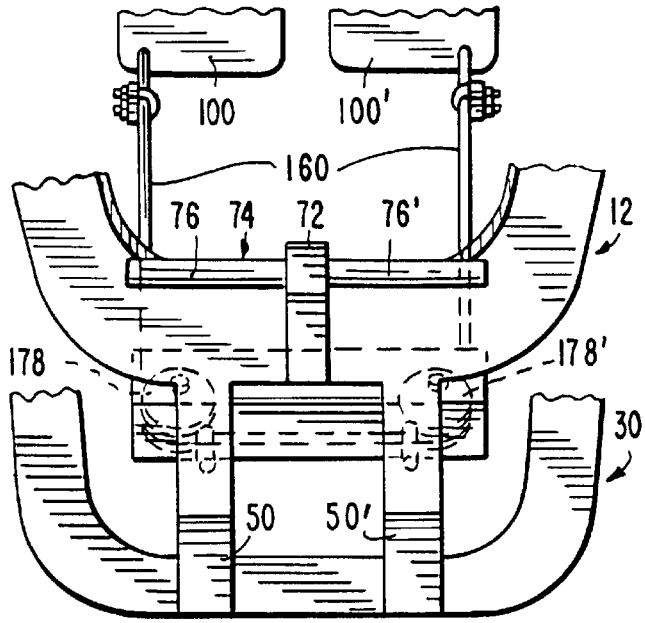
FIG. 5B is a plan view of the linkage mechanism of the exercise apparatus of FIG. 5A.

A fourth embodiment, shown in FIGS. 5A and 5B, uses a soft linkage in conjunction with an independent linear resistance. In this embodiment, the pedals 100/100' are linked together by cable 160, which is secured at each end to one of the pedals 100/100'. The cable 160 is journaled around cable return pulleys 178 and 178', which are mounted to the frame 10. In this case, the cable return pulleys 178/178' are preferably mounted to the front portion 24 of the top beam 12 or to the front beams 50/50' near the top beam 12. This location provides the optimal placement for maintaining the cable alignment with the pulleys 178/178' since the pulleys 178/178' are located approximately in line with the forward travel of the pedals 100/100'.

The resistance in the embodiment of FIGS. 5A and 5B is provided by shocks or hydraulic and/or air cylinders, such as one of the many models manufactured by Schrader-Bellows, DesPlains, Ill. The shocks 210 and 210' may optionally include adjustable resistance by way of a valve or the like. The shocks 210/210' are each connected to an arm 80/80' and the frame 10 so as to expand and contract as the arms 80/80' are reciprocated forward and back.

Figure 6A:
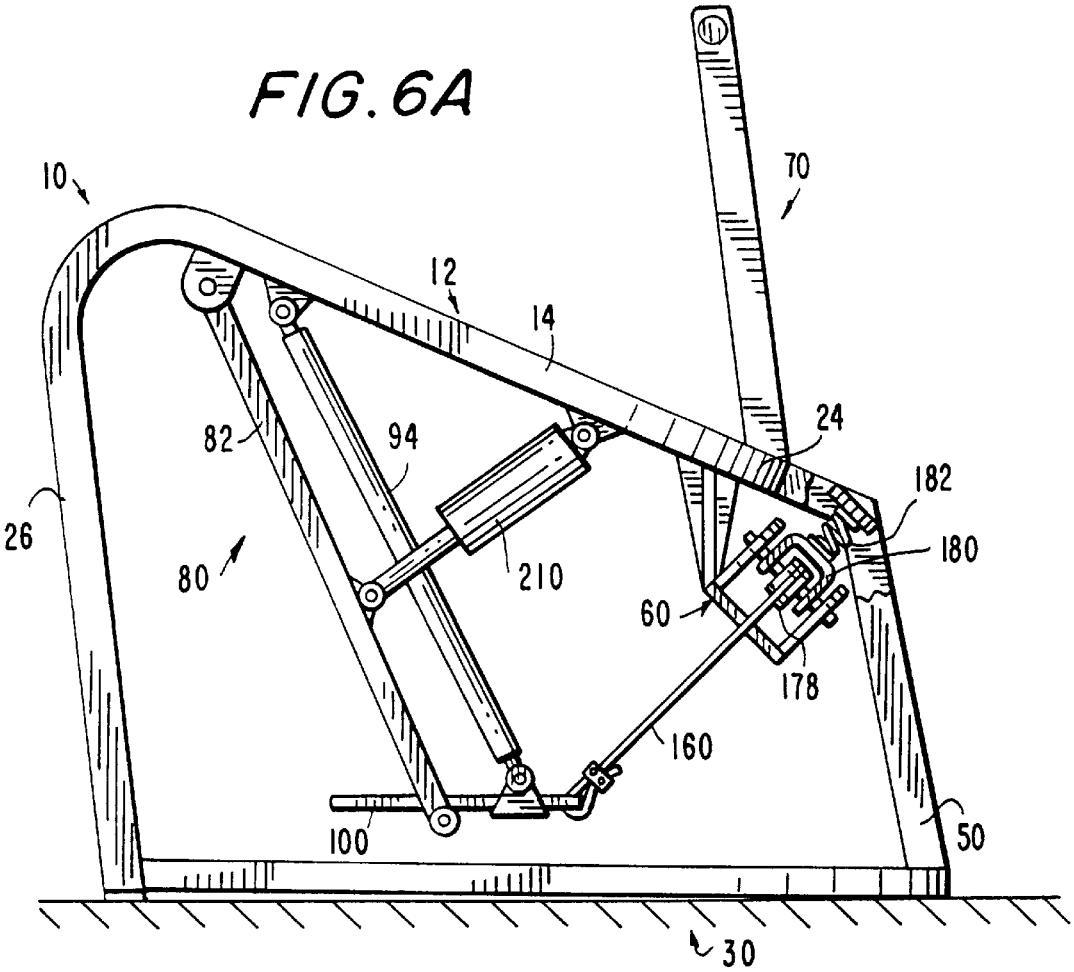
FIG. 6A is a partially cut-away side elevational view of another embodiment of the exercise apparatus of the present invention having a linear resistance and tether linkage with tensioning.

One acceptable mounting arrangement is to pivotally mount one end of shock 210 directly to main link 82 by a bushing, such as a Nylatron bushing manufactured by IGUS, East Providence R.I. The other end of the shock 210 is then pivotally mounted directly to the frame 10. The shock 210 may be mounted to the back portion 26 of the top beam 12, as shown in FIG. 5A, or it may be mounted to the side portion 14 of the top beam, as shown in FIG. 6A. Either location is acceptable, provided it allows for the full range of motion of the arm 80.

Adjustable resistance may alternatively be provided in these embodiments by mounting the shocks 210/210' to the frame 10 in a manner which allows for adjustment of the mounting position. For example, shock 210 may be mounted to the frame 10 in a manner which allows the mounting point to slide along the back portion 26 of the top beam 12. This changes the mechanical advantage of the arm 80 over the shock 210 and thereby changes the effective resistance. The same result could also be achieved by slidably mounting the shock 210 to the main link 82. Adjustable resistance can also be achieved by use of an internally adjustable shock in which users can set the desired load by turning a ring mounted to the shock.

As seen in the drawings, the embodiment of FIGS. 5A and 5B does not include an optional upper body attachment. Rather, this embodiment includes a stationary handle assembly 70. The stationary handle assembly 70 includes a handle beam 72 fixedly mounted at one end, by welding or some other means, to the lateral center of the front section 24 of the top beam 12. A substantially horizontal handle 74 is secured to the top end of the handle beam 72, and may include padded grips 76 and 76' to provide a comfortable surface for the user to grasp. The handle beam 72 extends up and back so that the handle 74 is disposed approximately where a user's outstretched arms would be during normal operation of the machine. The stationary handle 70 may also provide for adjustment if so desired. Adjustability may be accomplished by providing a telescoping handle beam 72 to allow for height adjustment and/or pivotally mounting the handle beam 72 to the frame 10 such that the incline of handle beam 72 may be adjusted.

Figure 6B:
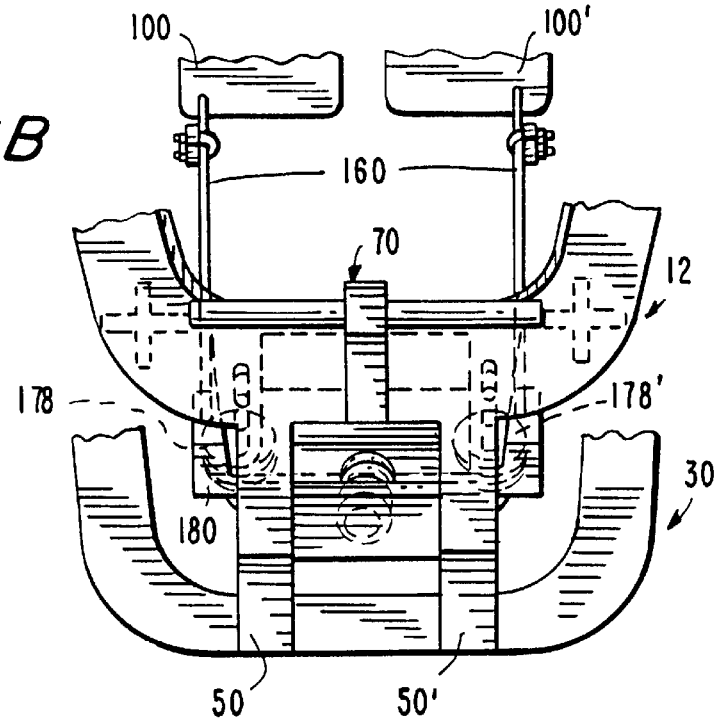
FIG. 6B is a plan view of the linkage mechanism of the exercise apparatus of FIG. 6A.

FIGS. 6A and 6B show a fifth embodiment of the present invention, which is similar to the embodiment of FIGS. 5A and 5B except the embodiment of FIGS. 6A and 6B includes a cable tensioning mechanism. Specifically, rather than mounting the cable return pulleys 178/178' directly to the frame, the pulleys 178/178' are mounted to a pulley carriage 180. The pulley carriage 180, in turn, is secured to the frame 10 by spring 182. A pulley stop 60 is also mounted to the frame 10 and is disposed to limit the travel of the pulley carriage 180 as the spring 182 is elongated. As in the second embodiment of FIGS. 3A and 3B, the spring 182 maintains constant tension on the cable 160, thereby preventing the cable 160 from jumping one of the pulleys 178/178'.

Figure 7A:
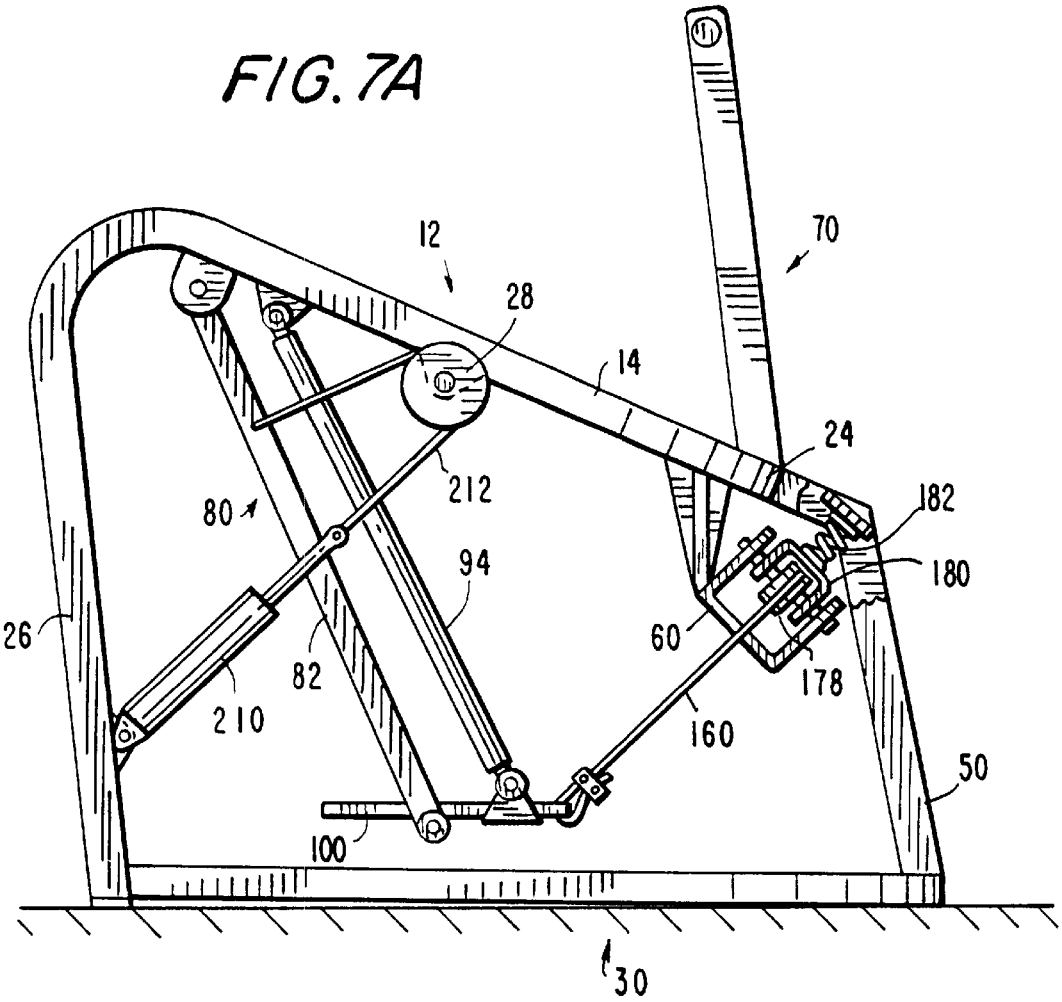
FIG. 7A is a partially cut-away side elevational view of another embodiment of the exercise apparatus of the present invention having a linear resistance and tether linkage with tensioning.
Figure 7B:
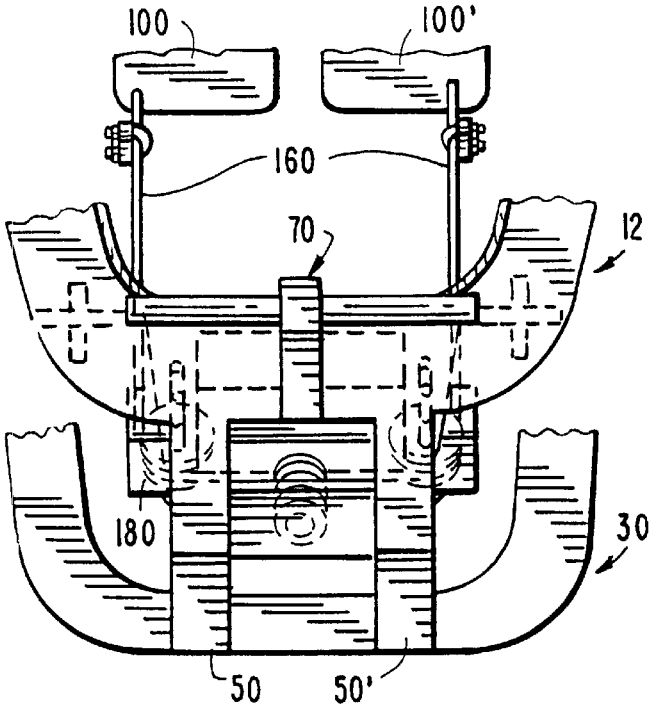
FIG. 7B is a plan view of the linkage mechanism of the exercise apparatus of FIG. 7A.

A sixth embodiment, shown in FIGS. 7A and 7B is identical to that of FIGS. 6A and 6B, except that the shocks 210/210' are indirectly connected to the arms 80/80'. One end of shock 210 is fixed to the back portion 26 of the top beam 12. The other end of the shock 210 is secured to a cable 212. The cable 212 is journaled around a pulley 28, which is mounted to the corresponding side portion 14 of the top beam 12. The other end of the cable 212 is secured to the arm 80, for example, to main link 82.

Using this arrangement, the shock 210 does not have to be pivotally mounted to the frame 10, since its movement will be linear between the mounting point on back beam portion 26 and the pulley 28. Additionally, by positioning the pulley 28 and the attachment point of the cable 212 to the arm 80 the resistance can be increased or decreased. Proper positioning creates a variable resistance through the stroke, for example, higher resistance at the top of the stroke and decreased resistance at the bottom of the stroke, or vice-versa.

Figure 8A:
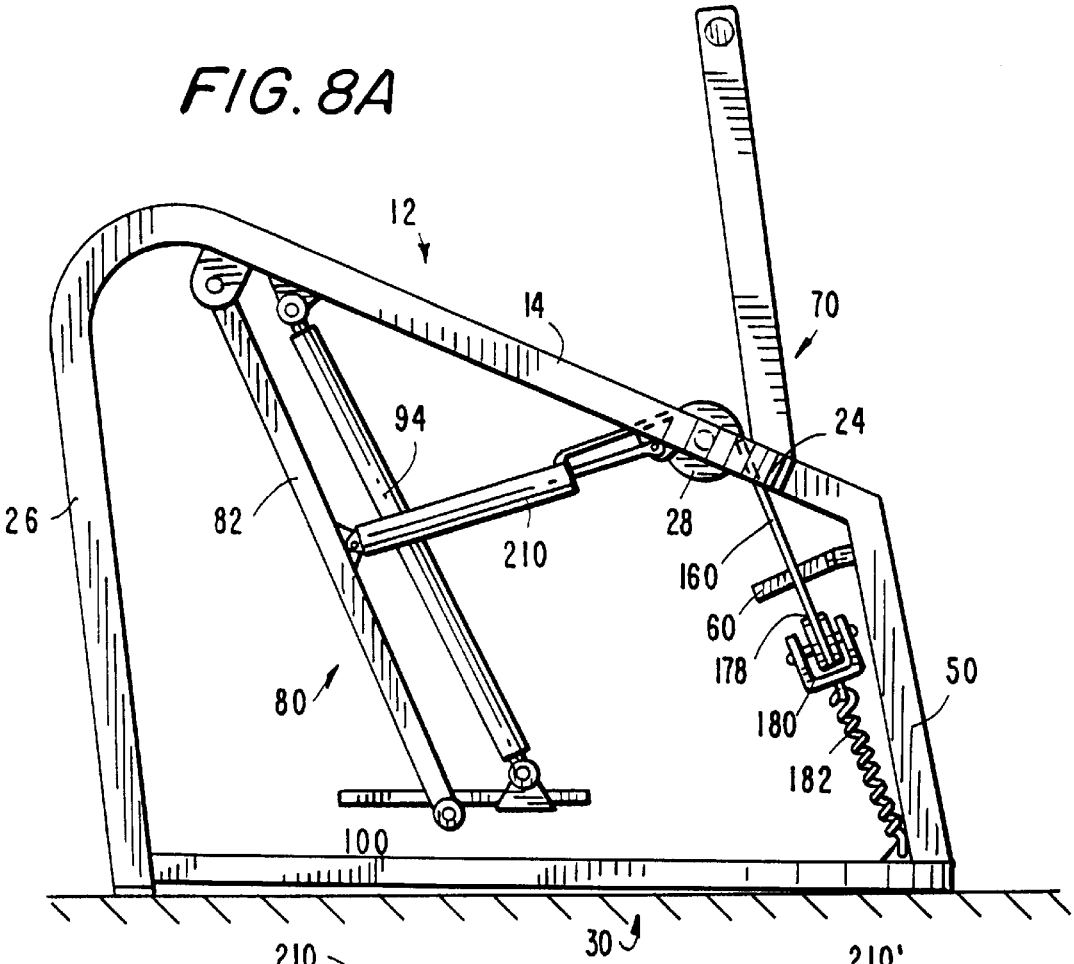
FIG. 8A is a side elevational view of another embodiment of the exercise apparatus of the present invention having a linear resistance and tether linkage with tensioning.
Figure 8B:
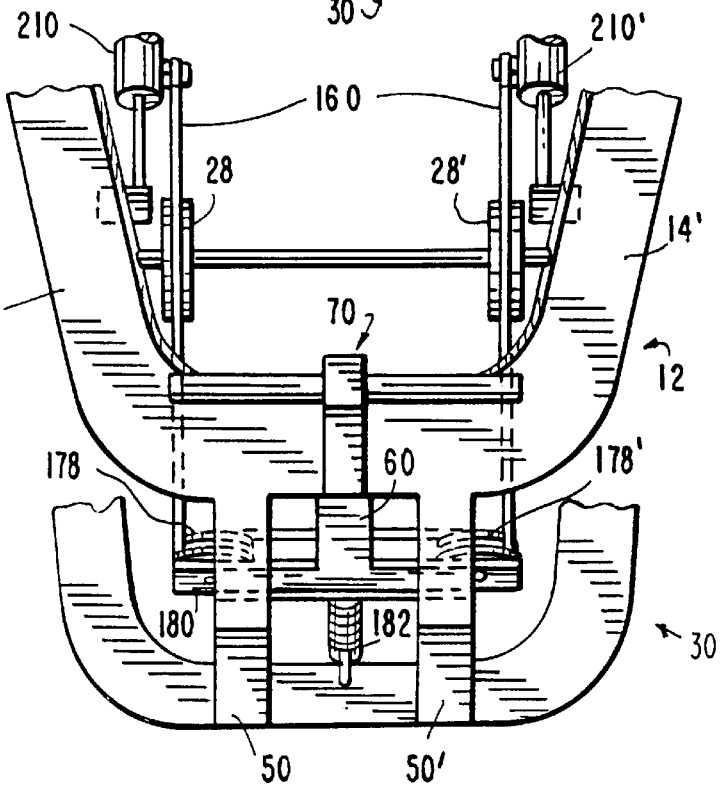
FIG. 8B is a plan view of the linkage mechanism of the exercise apparatus of FIG. 8A.

In a seventh embodiment, shown in FIGS. 8A and 8B, the shocks 210/210' are mounted between the side portions 14/14' of the top beam 12 and the main links 82/82' of the arms 80/80' as described in connection with FIGS. 6A and 6B. In the embodiment of FIGS. 8A and 8E, however, the ends of the cable 160 are connected to the body of the shocks 210/210' rather than to the pedals 100/100'. The middle section of the cable 160 is then journaled over guide pulleys 28/28', which are mounted to the side portions 14/14' of the top beam 12, and cable return pulleys 178/178'. The cable return pulleys 178/178' are mounted to a pulley carriage 180, which is secured to the frame 10 by spring 182. A pulley stop 60 is also mounted to the frame 10 and is disposed to limit the travel of the pulley carriage 180 as the spring 182 is elongated.

Referring to FIGS. 9–13, an eighth embodiment of the present invention is illustrated. This embodiment comprises a slightly different frame 310, which is also constructed of 1½×3 inch, 11 gauge rectangular steel tubing, and includes an alternator resistance and an independent hard linkage. As in the previous embodiments, descriptions of one side of the embodiment of FIGS. 9–13 should be understood to apply similarly to the other side.

The frame 310 of the FIGS. 9–13 embodiment includes two side beams 312/312', each side beam 312/312' having its back portion bent downward to form a rear leg 314/314'. The middle section 318/318' of each side beam 312/312' is angled down towards the front of the machine and the front portion is bent down further to form a front leg 332/332'. A brace 340/340' is mounted to the inner side of each side beam 312/312', preferably by welding, between the rear of the middle section 318/318' and the top of the rear leg 314/314'.

Two lateral front beams 350, 380 mounted to the side beams 312/312', preferably by welding, secure the side beams 312/312' to each other. (See FIG. 11) The top front beam 350, mounted to the side beams 312/312' just above the front leg bends 330/330', is slightly longer than the lower front beam 380, which is mounted to the front legs 332/332' at approximately their midpoint. Thus, the side beams 312/312' are angled slightly away from one another towards the back of the machine.

Figure 9:
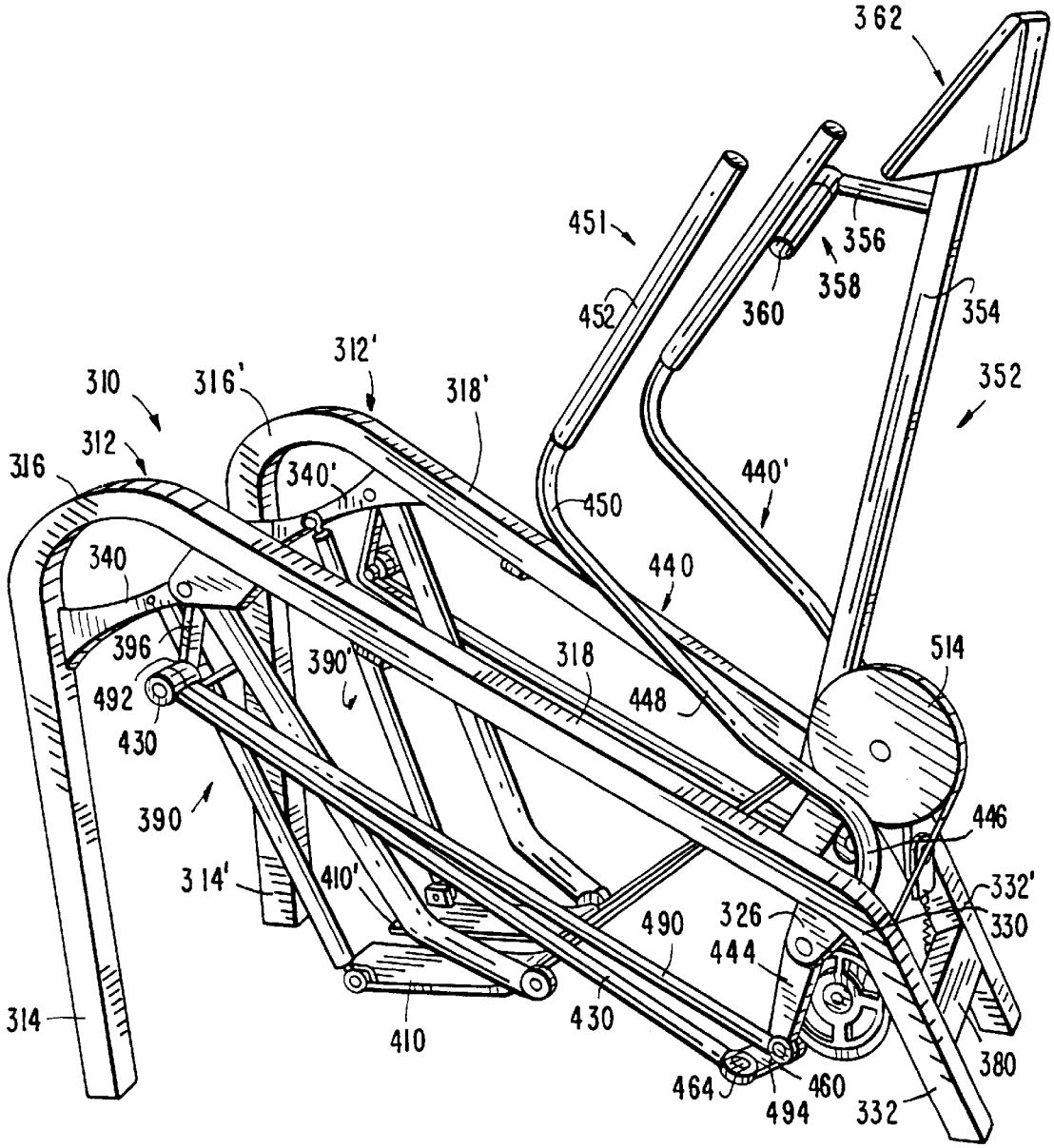
FIG. 9 is a perspective view of another embodiment of the exercise apparatus of the present invention having an alternator resistance and a bell crank linkage.
Figure 10:
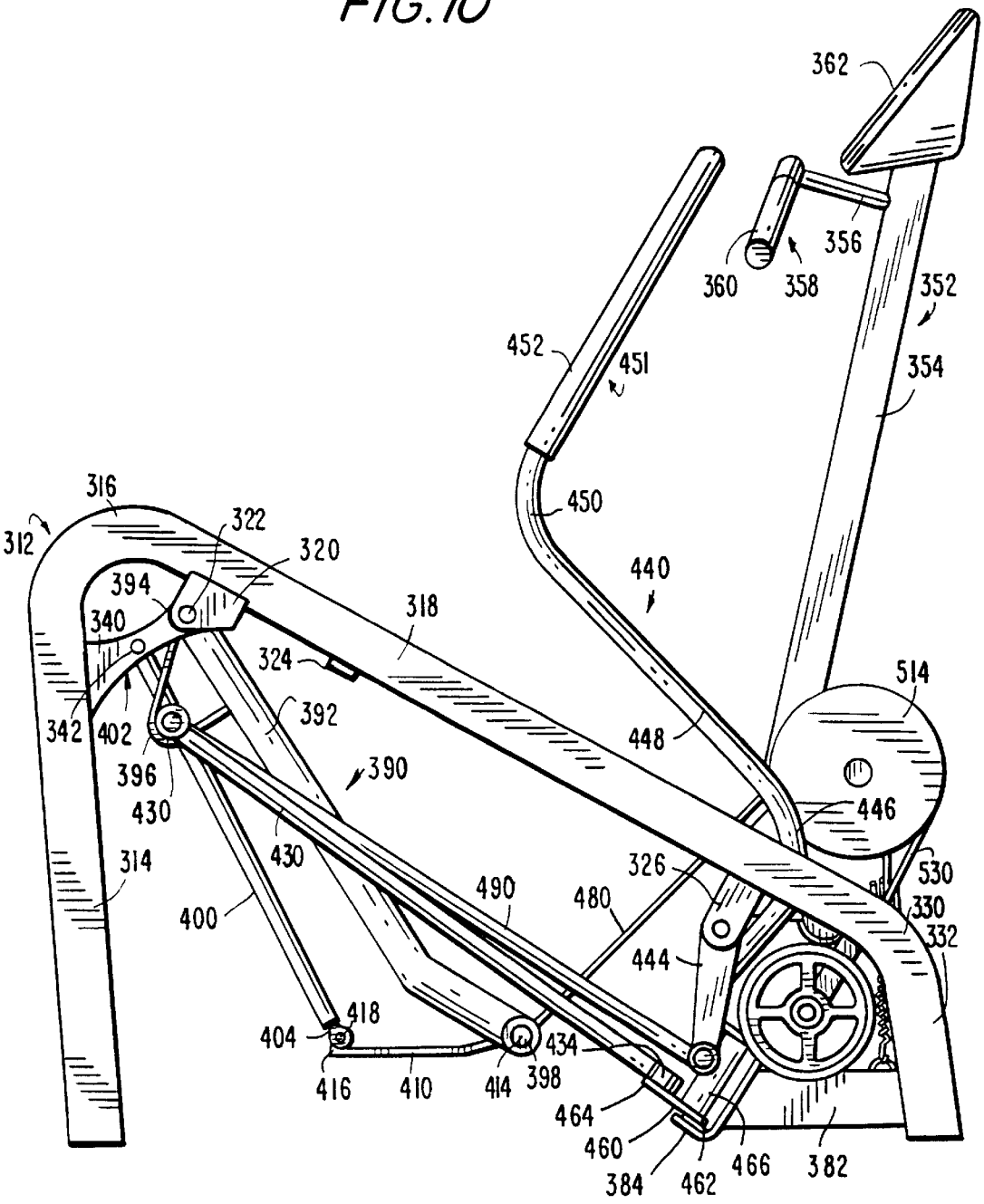
FIG. 10 is a side elevational view of the exercise apparatus of FIG. 9.

As best seen in FIGS. 9 and 10, two arms 390/390' supporting respective pedals 410/410' are pivotally mounted to the frame 310 proximate the rear leg bend 316/316'. As in the previous embodiments, the pivot points 322/322' of the arms 390/390' about the frame 310 are disposed above and behind the pedals 410/410' when the arms 390/390' are in the neutral position. The arm movement is similar to that described in connection with the previous embodiments and, likewise, in normal operation the pivot points 322/322' of the arms 390/390' remain below and behind the user's hips throughout the range of motion.

As in the previous embodiments, each arm 390/390' may comprise a four bar linkage in order to control the orientation of the pedals 410/410' throughout the rotation of the arms 390/390'. As best seen in FIG. 10, arm 390 includes a main link 392 which has bearing tubes 394, 398 mounted at either end. The top bearing tube 394 is pivotally mounted to the side beam 312 between the brace 340 and a flange 320 by sealed bearings, such as model #6205 metric bearings manufactured by SST, or an equivalent. The flange 320 is mounted to the outer side of the side beam 312, also by welding, directly across from the point where the brace 340 is mounted to the middle section 318 of the side beam 312. The bottom bearing tube 398 is mounted to a pedal bearing tube 412 by sealed bearings, such as model #6203 metric bearings manufactured by SST, or an equivalent, the pedal bearing tube 412 being welded to the underside of the corresponding pedal 410. A rubber stop 324 is mounted to the underside of the side beam middle section 318 to provide a cushion if the arm 390 is rotated too far forward.

Figure 12:
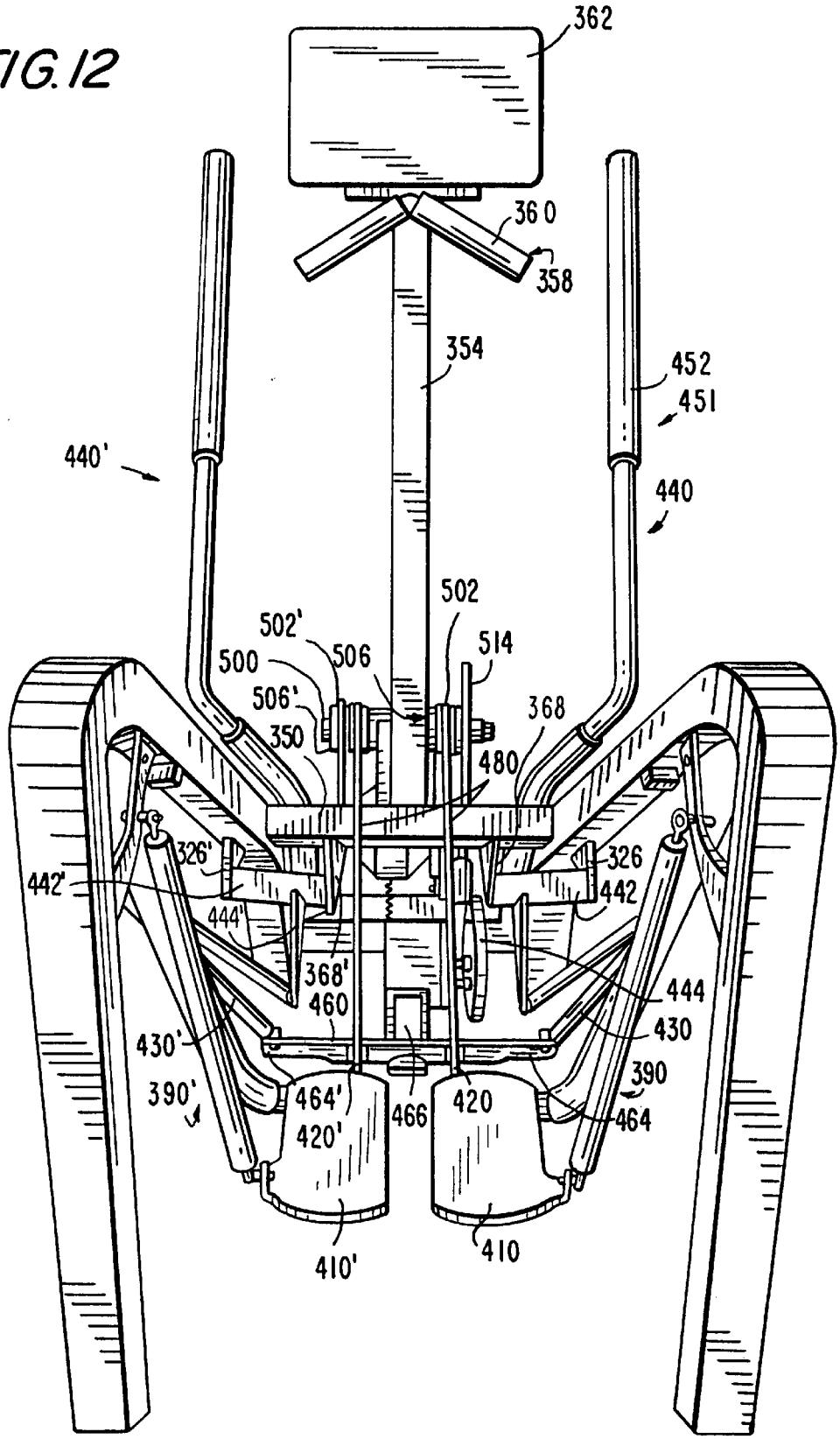
FIG. 12 is a rear view of the exercise apparatus of FIG. 9.

The pedals 410/410', similar to those of the previous embodiments, are plates covered with a non-skid material, each plate being large enough to accommodate the foot of a user. The lateral centers of the pedals 410/410' are approximately 8 inches apart in the neutral position so as to follow the natural stride of a user through the movement of the pedals 410/410'. As best seen in FIG. 12, the desired spacing is achieved in this embodiment by angling the arms 390/390' laterally in towards the lateral center of the machine at approximately 11° from vertical as they extend down when in the neutral position.

A secondary link 400 having eyelets 402, 404 mounted at either end is also pivotally mounted between the frame 310 and pedal 410. Unlike the previous embodiments, however, in this embodiment, the secondary link 400 is disposed in back of the main link 392 rather than in front of it. In particular, the top eyelet 402 is pivotally mounted to brace 340 at approximately its midpoint by a spherical rod end bearing such as model #HM-6 manufactured by Heim. The bottom eyelet 404 is likewise pivotally mounted to a flange 416 by a spherical rod end bearing such as model #HM-6 manufactured by Heim, the flange 416 being fixed to the respective pedal 410 in back of the main link 392. This arrangement provides for loading of secondary link 400 to be predominantly tension.

In this embodiment, main link 392 includes a slight bend with the two bearing tubes 394, 398 being spaced approximately 29½ inches apart. The secondary link 400 is approximately 23½ inches long. In addition, the distance between the main link/frame pivot axis 322 and the secondary link/frame pivot axis 342 is approximately 6⅝ inches, while the distance between the main link/pedal pivot axis 414 and the secondary link/pedal pivot axis 418 is approximately 10¾ inches.

Using this configuration, pedal 410 is angled down in front at approximately 170°–20° from horizontal when the arm 390 is rotated to its rear position, i.e., when the secondary link 392 is at 14° behind the vertical, with 0° being straight down. The pedal 410 is angled up in front at approximately 1°–5° from horizontal when the arm 390 is rotated to its forward position, i.e., when the secondary link 392 is at 69° forward of the vertical. When the arm 390 is in the neutral position, i.e., when the secondary link 392 is at 29° forward of the vertical, the pedal 410 is angled down in front at approximately 0°–5° from horizontal.

As indicated, the embodiment of FIGS. 9–13 employs an alternator resistance with a cable tensioning mechanism and an independent hard linkage. The hard linkage of this embodiment includes a bell crank 460, which is essentially an obtuse V-shaped bar with its ends 464/464' spaced approximately the same distance from each other as the arms 390/390'. The bell crank 460 is pivotally mounted to the frame at a point in front of the arms 390/390'. Specifically, a bell crank bearing tube 466 is mounted to the top of the bell crank 460 at its apex 462. The bell crank bearing tube 466 is mounted to a bracket 384 by sealed bearings, such as model #6203 metric bearings manufactured by SST. The bracket 384 is mounted to a bell crank beam 382, which is mounted to the bottom front beam 380 at its midpoint and extends back towards the rear of the machine. The bracket 384 is angled slightly such that the axis of the bell crank bearing tube 466 is approximately perpendicular to the connector links 430/430' (described below) when the arms 390/390' are in the neutral position.

Connector links 430/430', similar to the handle links 110/110' described in connection with the previous embodiments, are pivotally connected to arms 390/390' and to the corresponding ends 464/464' of the bell crank 460. Referring to FIG. 10, a mounting bracket 396 is welded to main link 392 and extends towards the rear of the machine. The connector link 430 includes bearing tubes 432, 434 at either end which are mounted to the mounting bracket 396 and to the end of the bell crank 460 by sealed bearings, such as model #6205 metric bearings manufactured by SST. The length of the connector links 430/430' is selected so that when in the neutral position, i.e., where both arms 390/390' are aligned, the pedals 410/410' are disposed in front of and below the pivot axis 322/322' of the arms 390/390' about the frame 310, just as in the case of the soft linkage.

The arms 390/390' are, therefore, "hard" linked by the bell crank 460. When one arm, for example, arm 390 is driven back by a user applying force to the attached pedal 410, the connector link 430 pulls the corresponding end 464 of the bell crank 460 back a proportional distance. This causes the opposite end 464' of the bell crank 460 to move forward the same distance. The opposite connector link 430', also connected to the bell crank 460, is then drawn forward, which pulls the opposite arm 390' forward an equal, but opposite, distance as the driven arm 390 was moved back. As in the case of the soft linkage, when the non-driven arm 390' reaches the desired forward most position, the user reverses the application of force, urging the previously non-driven arm 390' back while allowing the other arm 390 to return to the forward position.

Figure 11:
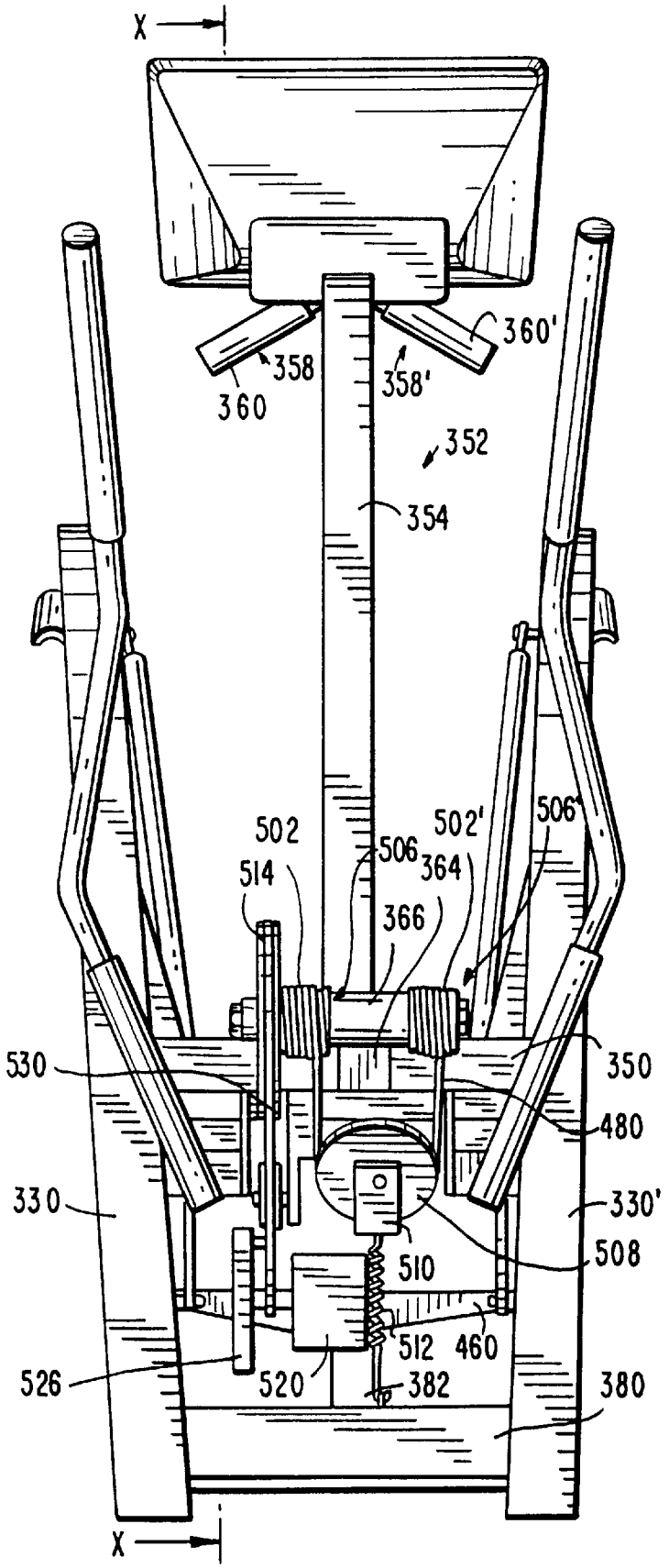
FIG. 11 is a front view of the exercise apparatus of FIG. 9.
Figure 13:
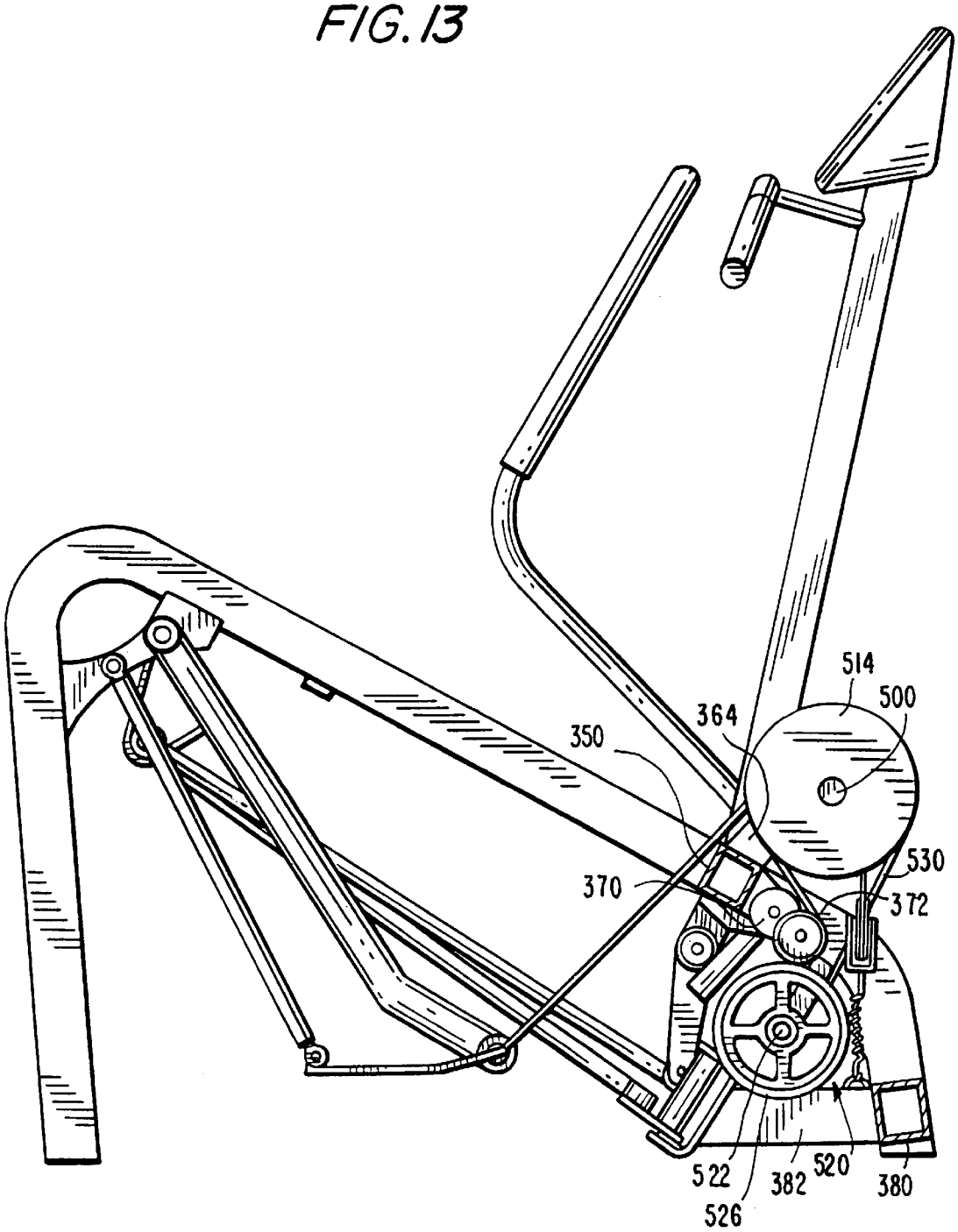
FIG. 13 is a cross-sectional view of the linkage and resistance mechanisms of the exercise apparatus of FIG. 9 taken along line X—X in FIG. 11.

Similar to the previously described embodiments, an alternator resistance is used in the embodiment of FIGS. 9–13. In this embodiment, however, the shaft 500 is mounted to a shaft bearing tube 366 by sealed bearings, such as model #6205 metric bearings manufactured by SST. Referring to FIGS. 11–13, the shaft bearing tube 366 is mounted to a shaft support beam 364, which is fixed to the top front beam 350 and extends forward.

Helical groove pulleys 502 and 502' are mounted to the shaft 500 on either side of the shaft bearing tube 366 by corresponding one-way clutches 506 and 506'. The one-way clutches 506/506' function, as described above, to engage the helical pulleys 502/502' to the shaft 500 when the attached pulley 502/502' is rotated in one direction, and disengage the helical pulleys 502/502' from the shaft 500 and allow the shaft 500 to rotate freely when attached pulley 502/502' is rotated in the opposite direction. A drive pulley 514 is fixed to the shaft 500 adjacent one of the helical groove pulleys 502 so as to rotate with the shaft 500.

FIG. 13 is a partial cross-sectional view of the resistance mechanism of the thirteenth embodiment taken along line X—X in FIG. 11. An alternator 520 is mounted to the frame 310 proximate to the drive pulley 514. The alternator 520 is identical to the one described above and includes a drive shaft 522 having an alternator pulley 524 and a flywheel 526 mounted on it. The alternator 520 is mounted to the bell crank beam 382 such that the alternator pulley 524 is below and laterally aligned with the drive pulley 514. The drive pulley 514 is connected to the alternator pulley 524 by a drive belt 530, thereby coupling the alternator 520 to the shaft 500.

The drive belt 530 is also journaled around a guide pulley 372, which maintains tension on the drive belt 530 and guides the drive belt 530 around the top front beam 350. The guide pulley 372 is mounted to the top front beam 350 by a mounting bracket 370. In the illustrated embodiment, the mounting bracket 370 comprises an automatic tensioning device, such as that available commercially from Efson, Wilmington, N.C., using an Elastomer spring to maintain tension. In this embodiment, one end of the tensioning device 370 is mounted to the top front beam 350 and the guide pulley 372 is mounted at the other end of the device 370, such that it maintains constant tension on the drive belt 530 without the need for adjustment.

In an alternate embodiment, mounting bracket 370 comprises two arms joined by a locking hinge. One arm of the bracket is fixed, for example, by welding at an end distal from the hinge, to the top front beam 350 and extends forward such that the locking-hinge is disposed in front of the top front beam 350. The second arm of the locking-hinge bracket 370 extends downward and has the guide pulley 372 mounted at the end distal from the hinge. The axis of the hinge is parallel to that of the shaft 500 and the alternator drive shaft 522 such that movement of the moveable arm causes the guide pulley 372 to move in the same plane as the drive pulley 514 and the alternator pulley 524. The guide pulley 372 is thereby kept in alignment with the drive belt 530 regardless of the orientation of the moveable arm.

In operation, the guide pulley 372 contacts the outer surface of the drive belt 530 and the hinge is adjusted and locked in position to maintain a constant tension on the belt 530. Many type locking hinges are known and may be employed in the current invention. One acceptable configuration is to form corresponding radial grooves on the hinge arm surfaces where they contact each other about the hinge axis. A locking nut and bolt through the hinge axis could then be tightened to engage the arms together to prevent rotation and loosened to allow for adjustment or replacement of the belt 530.

Similar to the previous embodiments, a single cable 480 is used to connect the pedals 410/410' to the resistance mechanism. Referring to FIGS. 10–12, each end of the cable 480 is secured to one of the two pedals 410/410' at an eyelet 420/420' mounted to the front of each pedal 410/410'. The cable 480 extends from each pedal 410/410' to a corresponding one of the helical pulleys 502/502' and is wrapped around each helical pulley 502/502' at least once. Accordingly, when one of the pedals, for example, pedal 410 is moved backward, the corresponding one-way clutch 506 engages the pulley 502 to the shaft 500 and drives the shaft 500. The one-way clutches 506/506' are oriented in the same direction so that both pedals 410/410 drive the shaft 500 in the same direction.

The center portion of the cable 480 is journaled around a cable return pulley 508, which is mounted to a pulley carriage 510 and secured to the lower front beam 380 by a spring 512, in a manner similar to the previous embodiments. In this embodiment, however, the cable 480 functions solely to connect the pedals 410/410' to the resistance assembly and does not provide linkage between the pedals 410/410' as in the earlier embodiments. Thus, the cable return pulley 508 and spring 512 act only to maintain tension on the cable 480 to compensate for any change in the length of the cable 480 (for example, due to stretching) and to prevent the cable 480 from possibly jumping one of the pulleys. A pulley stop, such as pulley stop 60 in FIGS. 3A and 3B, is, therefore, not required.

As seen in the drawings, the embodiment of FIGS. 9–13 includes both an upper body exercise attachment and a stationary handle assembly 352. This provides the user with the option of exercising the upper body concurrently with the lower body or exercising the lower body alone.

The stationary handle assembly 352 includes a handle beam 354 fixedly mounted at one end, for example, by welding, to the top front beam 350 proximate to the mounting point of the shaft support beam 364 to the top front beam 350. A handle post 356 is welded on one end to the top of the handle beam 354 and extends towards the rear of the machine. A pair of handles 358/358' are secured to the back end of the handle post 356 and are angled down and back slightly. Padded grips 360/360' are disposed on the handles 358/358' to provide a comfortable surface for the user to grasp. Rather than being mounted to the top front beam 350, the handle beam 354 may alternatively be mounted to the lower front beam 380, however, in either case the handle beam 354 is oriented so that the handles 358/358' are disposed approximately where a user's outstretched arms would be during normal operation of the machine, and may optionally provide for adjustment if so desired.

Similar to the previously described embodiments, the upper body exercise attachment of the embodiment of FIGS. 9–13 includes two handles 440 and 440' which are pivotally attached to the frame 310 and operably engaged to the respective pedals 410/410' so as to reciprocate back and forth in synchronization with the pedal movement. As best seen in FIGS. 9, 10 and 12, flange 326 is welded to the underside of the middle section 318 of side beam 312 adjacent the top front beam 350. Opposing flange 368 is mounted to the underside of the top front beam 3S0 at a point spaced from the side beam 312. A handle bearing tube 442 is pivotally mounted between the flanges 326, 368 by sealed bearings, such as model #6203 metric bearings manufactured by SST, or an equivalent.

Because of the differences in the frame structure from the previous embodiments, the handles 440/440' in the embodiment of FIGS. 9–13 also have a slightly different structure. Starting from the bottom, handle 440 is secured to the handle bearing tube 442 and extends up in front of the top front beam 350, adjacent to the corresponding side beam 312, a sufficient distance to clear the top front beam 350. The handle 440 then has a lower bend 446 and extends towards the rear of the machine. A second bend 448 redirects the handle 440 in towards the lateral center of the machine to position them at a comfortable distance from one another for an average user. A final bend 450 then directs the handle 440 upward and to a substantially straight portion 451 which is adapted to accommodate users of various heights. Optionally, a padded grip 452 may be disposed on the top section 451 of the handle 440 to provide a comfortable surface for the user to grasp.

A triangular handle flange 444 is also mounted to the handle bearing tube 442 and extends down in the opposite direction of the handle 440. A handle link 490, similar to that of the previous embodiments, is connected to the triangular flange 444 and to arm 390 so as to cause handle 440 to reciprocate 180° out of phase with the movement of the corresponding pedal 410, as previously described. Specifically, the handle link 490 includes bearing tubes 492, 494 fixed at either end which are mounted to the main link 392 at mounting bracket 396 and to the triangular flange 444 by sealed bearings, such as model #6205 metric bearings manufactured by SST.

In operation, a user first positions a foot on each pedal 410/410' and grasps the handles 440/440'. (Alternatively, the user may choose to grasp the stationary handles 358/358', in which case the following description is still applicable, except the user's arms are not moved with the moving handles 440/440') The user then begins reciprocating his feet back and forth, working against the resistance of the alternator 520, and selects the desired resistance level (manual mode) or may optionally select a preprogrammed exercise program (automatic mode). In the embodiment of FIGS. 9–13, the alternator controls are integrated in a microprocessor system to implement the above programmability, as is known in the art.

The microprocessor system is mounted to the frame 310 with at least part of the system being disposed in a control panel 362, which is mounted to the top of the stationary handle beam 354 just in front of the stationary handles 358/358'. This position provides a convenient location for a display, for example, a digital display, to convey information to the user such as elapsed time, current resistance level, calories burned and/or estimated distance traveled by the user. The control panel 362 also includes a keypad or the like for the user to set the resistance level and enter data required by the microprocessor to select a desired workout program. The input data may include, for example, user weight, desired workout time, desired workout/resistance level and program type. In addition, a conventional heart rate monitor may be included, either integral with the alternator controls microprocessor, or as an independent system.

The oscillation of the arms 390/390' causes the handles 490/490' to simultaneously oscillate out of phase with the arms 390/390'. For example, as arm 390 is driven back, attached handle link 490 is also driven back a proportional distance. This in turn pulls the triangular handle flange 444 back causing the handle bearing tube 442 to rotate about its axis. The handle 440 attached to the handle bearing tube 442 is thereby driven forward a distance which is proportion to the distance which the corresponding pedal 410 was driven back. Conversely, when arm 390 is drawn forward by connecting link 430, the attached handle link 490 is driven forward thereby pushing the triangular handle flange 444 forward and rotating the handle bearing tube 442 about its axis in the opposite direction. The handle 440 attached to the handle bearing tube 442 is thereby driven back, once again, a distance which is proportion to the distance which the corresponding pedal 410 was driven.

The oscillation of the arms 390/390' also drives the resistance mechanism. As the arm 390 is moved backward (i.e., in the driving direction) under the force of a user's leg, the cable 480 connected to the pedal 410 pulls the corresponding helical pulley 502 in the drive direction and the attached one-way clutch 506 engages the pulley 502 to the shaft 500, thereby driving the shaft 500. At the same time, the cable 480, journaled around the cable return pulley 508, pulls the other helical pulley 502' in the return (i.e., non-driving) direction and is allowed to spin freely by its one-way clutch 506', thereby drawing the cable 480 forward as the non-driven arm 390' is simultaneously driven forward by the bell crank 460 (described above). When the non-driven arm 390' reaches the desired forward most position, the user reverses the application of force, urging the previously non-driven arm 390' back while allowing the previously driven arm 390 to return to the forward position.

As stated above, the user may select a short or long stride, with the movement of the pedals 410/410' being equal and 180° out of phase by virtue of the lower bell crank linkage. In addition, the speed of the pedal movement is controlled by the user and is limited only by the selected resistance of the alternator 520. As in the previous embodiments, the pivot points 322/322' of the arms 390/390' remain below and behind the user's hips throughout the range of motion, regardless of the stride length or speed selected.

Figure 14A:
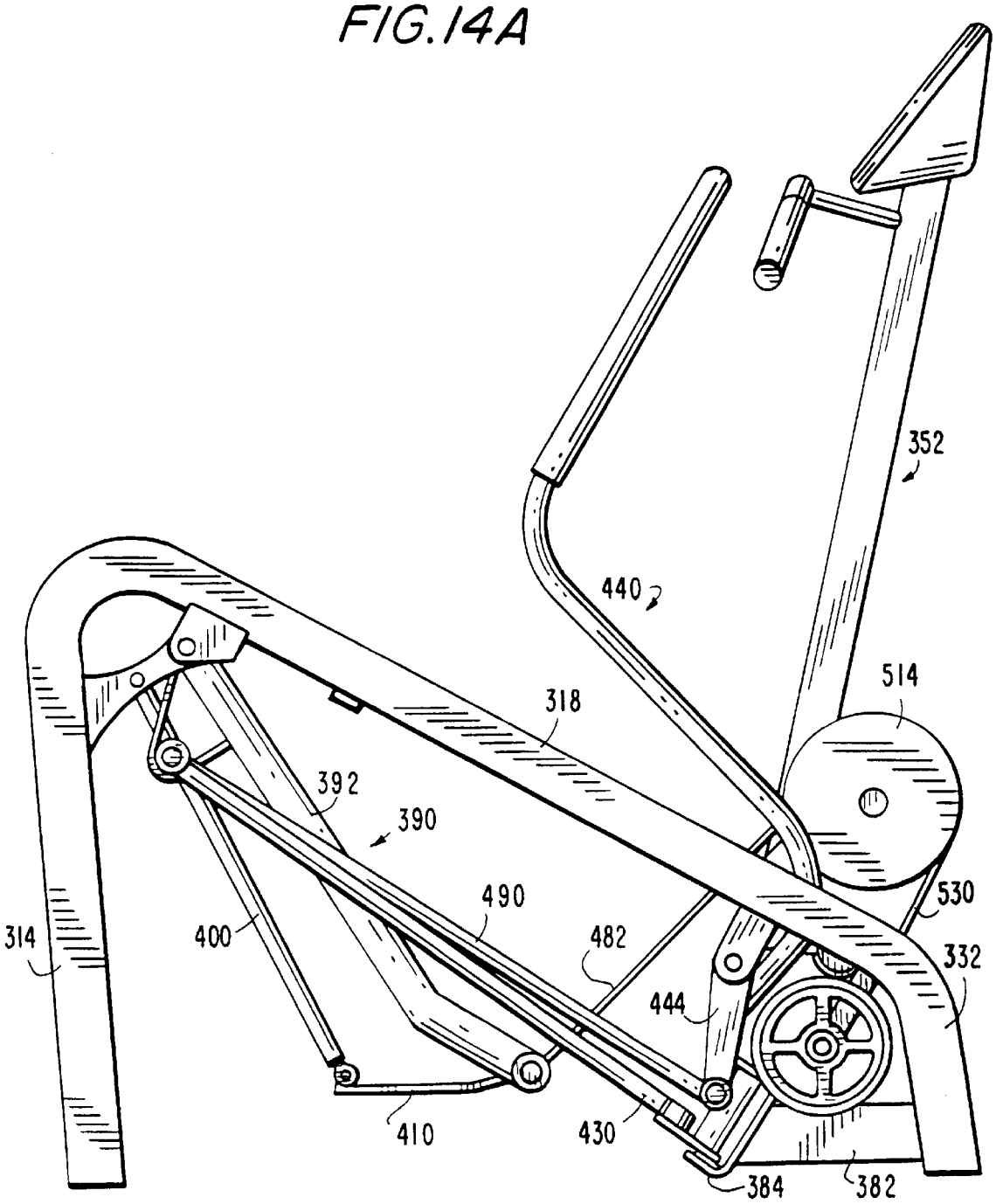
FIG. 14A is a side elevational view of another embodiment of the exercise apparatus of the present invention having an alternator resistance and bell crank linkage.
Figure 14B:
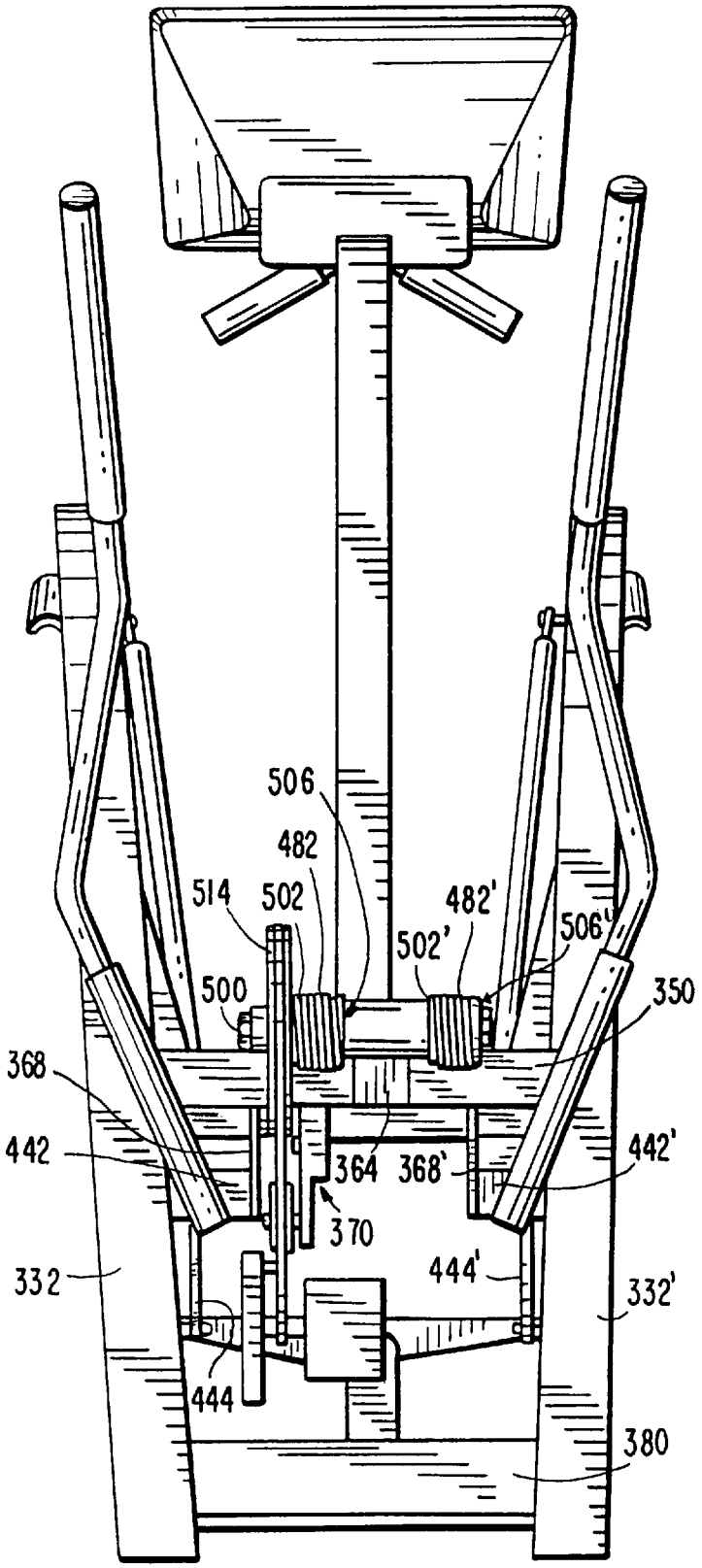
FIG. 14B is a front view of the exercise apparatus of FIG. 14A.

A ninth embodiment of the present invention, illustrated in FIGS. 14A and 14B, is identical to that described in connection with FIGS. 9–13 except there are two individual cables 482 and 482' rather than one. Each cable 482/482' is connected at one end to a pedal 410/410' and is fixed at the other end to a corresponding one of the helical pulleys 502/502'. Accordingly, the pedals 410/410' are not linked together by a single cable and the cable return pulley is, therefore, not required. In addition, the one-way clutches 506/506' include recoil springs which urge the helical pulleys 502/502' in the free spinning (i.e., disengaged) direction. A similar system is disclosed in U.S. Pat. No. 4,082,267, which is hereby incorporated by reference.

In operation, when an arm, for example, arm 390 is moved backward (i.e., in the driving direction) under the force of a user's leg, the cable 482 attached to it pulls the corresponding helical pulley 502 to which it is attached and causes it to rotate in the drive direction as the cable 482 is uncoiled from the pulley 502. The helical pulley 502 becomes engaged to the shaft 170 by the one-way clutch 506 and consequently drives the shaft 170 in the drive direction. When the user releases the force on the pedal 410 and the pedal 410 is urged forward by the bell crank linkage, the recoil spring causes the helical pulley 502 to rotate in the opposite (i.e., free spinning) direction, thereby recoiling the cable 482 onto the helical pulley 502.

Figure 15A:
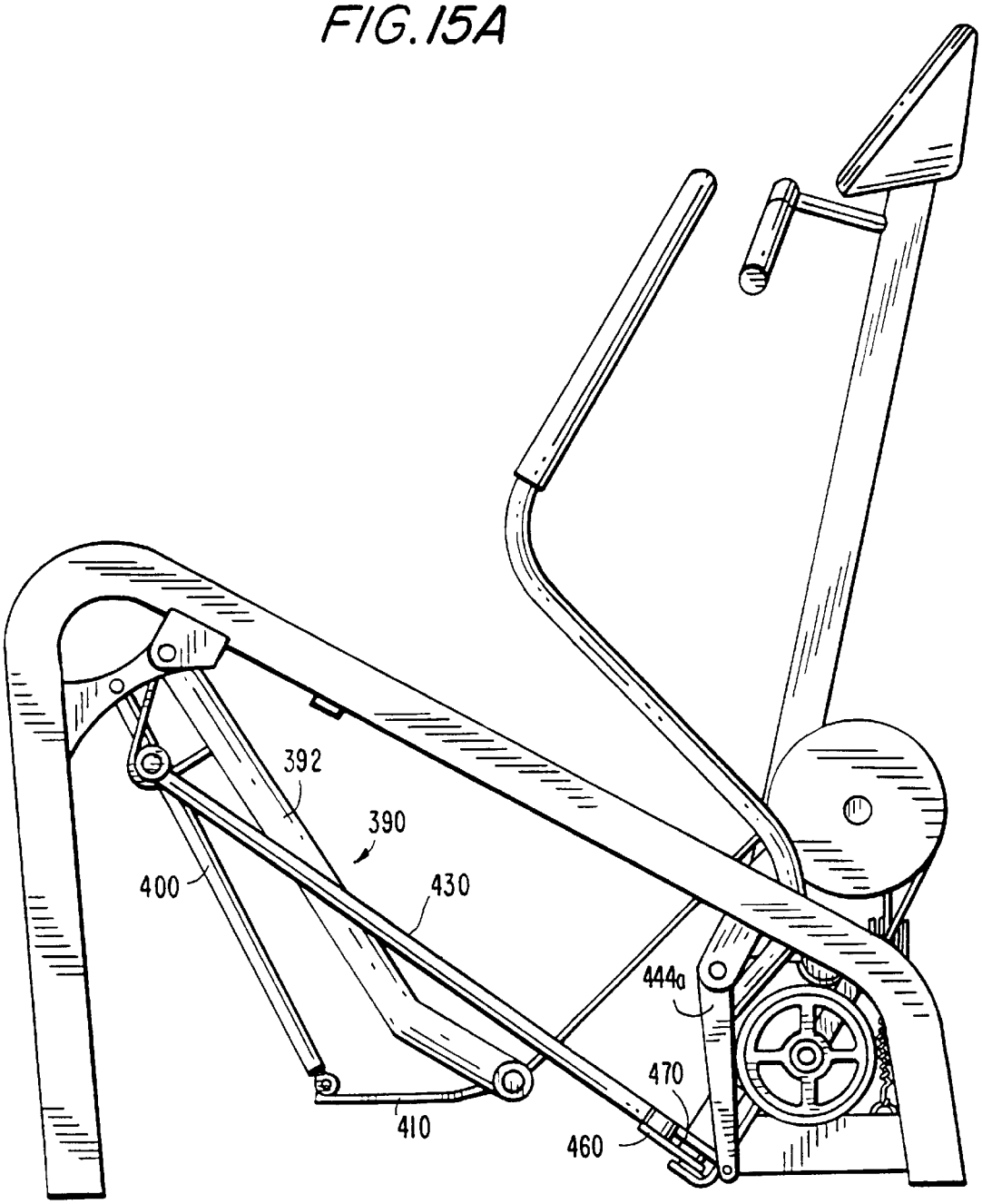
FIG. 15A is a side elevational view of another embodiment of the exercise apparatus of the present invention having an alternator resistance and bell crank linkage.
Figure 15B:
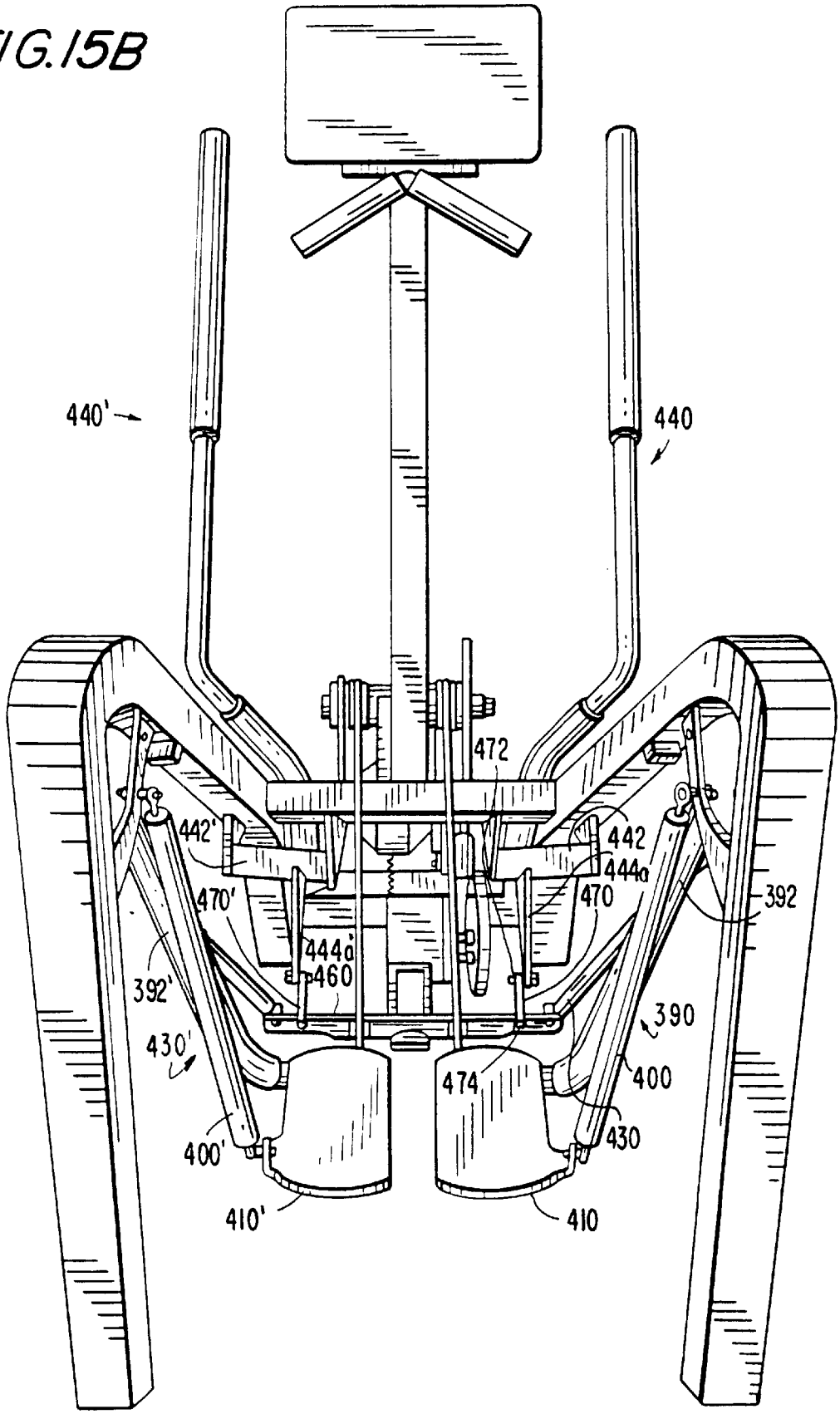
FIG. 15B is a rear view of the exercise apparatus of FIG. 15A.

With reference to FIGS. 15A–16B, either the connector or the handle links may be omitted from both sides while maintaining the same functionality as the embodiment of FIGS. 9–13. The tenth embodiment, shown in FIGS. 15A and 15B, is identical to the embodiment of FIGS. 9–13 except the handle links 490/490' are omitted. In this embodiment, the handles 440/440' are instead connected to the arms 390/390' via the bell crank 460 by way of a pair of intermediate links 470 and 470'. The handles 440/440' are identical to that described in connection with FIGS. 913 and are mounted in a similar fashion. The triangular flanges 444*a*/444*a*' are, however, slightly longer so as to extend to a point in line with the bell crank 460. Intermediate link 470 is no more than a short rod having bearing tubes 472, 474 at either end for mounting to the bell crank 460 and the handle 440 by means of sealed bearings, such as model #6200 manufactured by SST. Thus, in the embodiment of FIGS. 15A and 15B, the handle 440 is connected to the bell crank 460, and hence the connector link 430 and the arm 390, by intermediate link 470.

Other than the noted structural difference, the handles 440/440' and bell crank 460 function the same as described above. When one arm, for example, arm 390 is driven back by a user applying force to the attached pedal 410, the connector link 430 pulls the corresponding end 464 of the bell crank 460 back a proportional distance. This causes the intermediate link 470 to be drawn back a proportional distance, thereby urging handle 440 forward. Conversely, when arm 390 is drawn forward by the connector link 430, intermediate link 470 is driven forward thereby urging the handle 440 back. In all cases, the speed and range of motion of the handles 440/440' is directly proportional to that of the pedals 410/410'.

Alternatively, connector links 430/430' may be omitted while retaining handle links 490/490'. Referring to the eleventh embodiment illustrated in FIGS. 16A–16C, a slightly different intermediate link 470*a* is utilized to connect the arms 390/390' to the bell crank 460 via the handle links 490. Once again, the handles 440/440' are identical to that described in connection with FIGS. 9–13, however, in this embodiment, the triangular flanges 444/444' are replaced by handle levers 454/454'.

The handle lever 454 is mounted to the handle bearing tube 442 and to handle link 490 in a manner similar to the triangular flange 444. In addition, a flange 456 is mounted to the front of handle lever 454 and has a bearing tube 458 mounted at its end distal the handle lever 456. Bell crank beam 382 is shorter than in the embodiment of FIGS. 9–13 and has intermediate link bearing tubes 468/468' mounted at each end 464/464'. Because the bell crank beam 382 is shorter than in the previous embodiments, the alternator 520 in this embodiment is mounted to the top front beam 350 by an alternator mounting bracket 378.

Intermediate link 470*a* has brackets 476, 478 fixed to each end and is mounted to the handle lever 454 and bell crank 460 at bearing tubes 458 and 468. Thus, the bell crank 460 is connected to the handles 440/440', and consequently the arms 390/390', by intermediate link 470*a*. The axes of the bearing tubes 458 and 468 are skew, and preferably perpendicular to one another to act as a universal type joint connection between the handle 440 and the bell crank 460. This allows for free rotation of both the handle 440 and the bell crank 460 about their respective axes without binding. In the illustrated embodiment, the axis of the bearing tube 458 is parallel to the axis of the handle bearing tube 442, and the axis of the bearing tube 468 is parallel to the axis of the bell crank bearing tube 466, however, other orientations of the bearing tubes may be employed.

In operation, when one arm, for example, arm 390 is driven back by a user applying force to the attached pedal 410, the handle link 490 pulls handle lever 454 back. This causes the intermediate link 470*a* to be drawn back, thereby drawing the corresponding end 464 of the bell crank 460 back a proportional distance. Conversely, when the end 464 of the bell crank is driven forward, intermediate link 470*a* is pulled forward thereby urging the handle lever 454 forward and the handle 440 back. At the same time, arm 390 is drawn forward by the handle link 490.

With reference to FIG. 16C, the intermediate link 470*a* may optionally include a flexible elastomer portion to allow flex in the relative motion between the two mutually perpendicular planes of the bell crank 460 and the handle lever 454. In the intermediate link 470*a* of FIG. 16C, the portion connecting brackets 476 and 478 is a tubular member 479 formed of a flexible elastomer. A cable 477 having ball ends 475 at each end is disposed through the center of the tubular member 479. The ball ends 475 are seated in apertures in the brackets 476 and 478 to secure the brackets 476 and 478 to each other and to maintain the tubular portion 479 in compression.

Figure 16A:
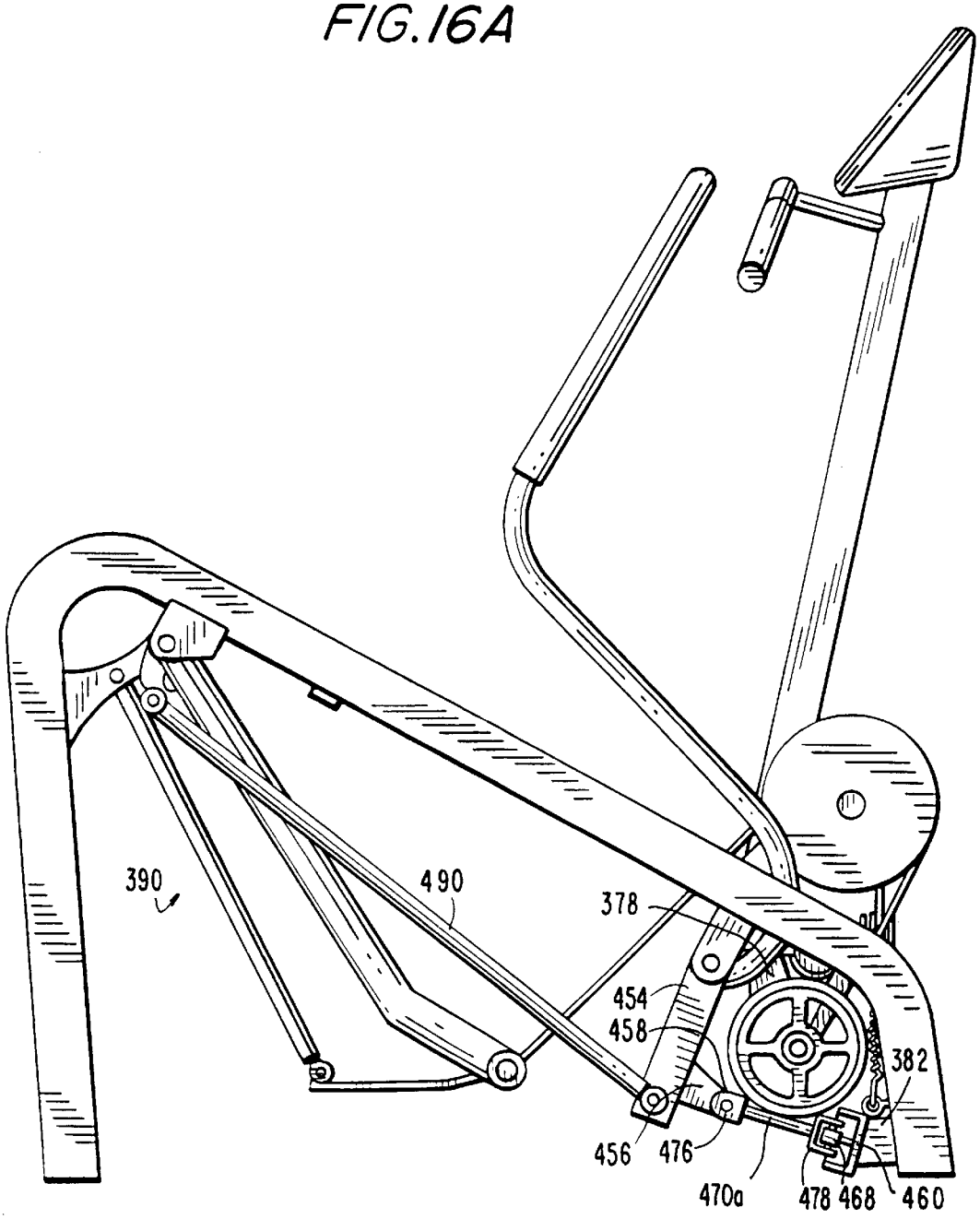
FIG. 16A is a side elevational view of another embodiment of the exercise apparatus of the present invention having an alternator resistance and bell crank linkage.
Figure 16B:
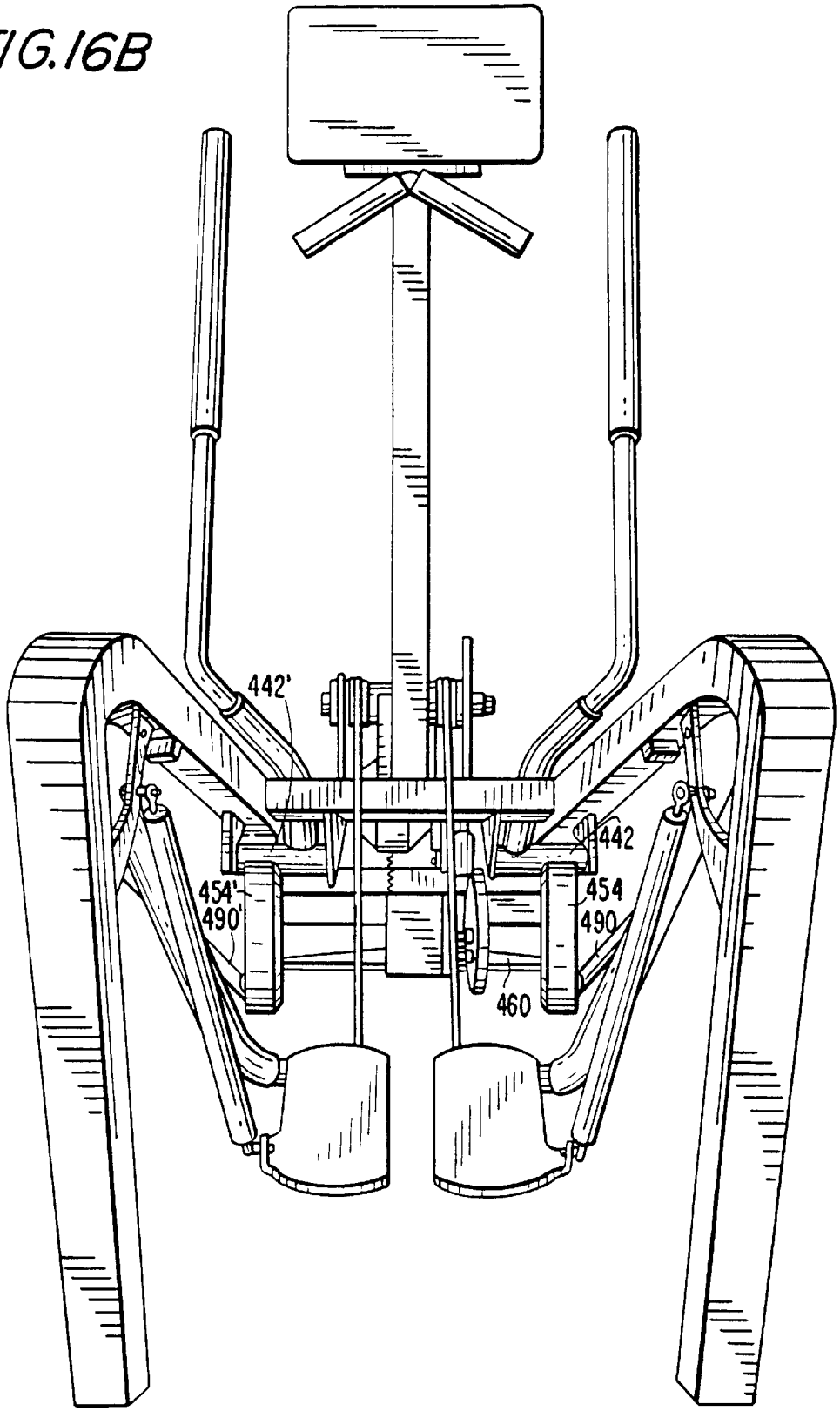
FIG. 16B is a rear view of the exercise apparatus of FIG. 16A.
Figure 17A:
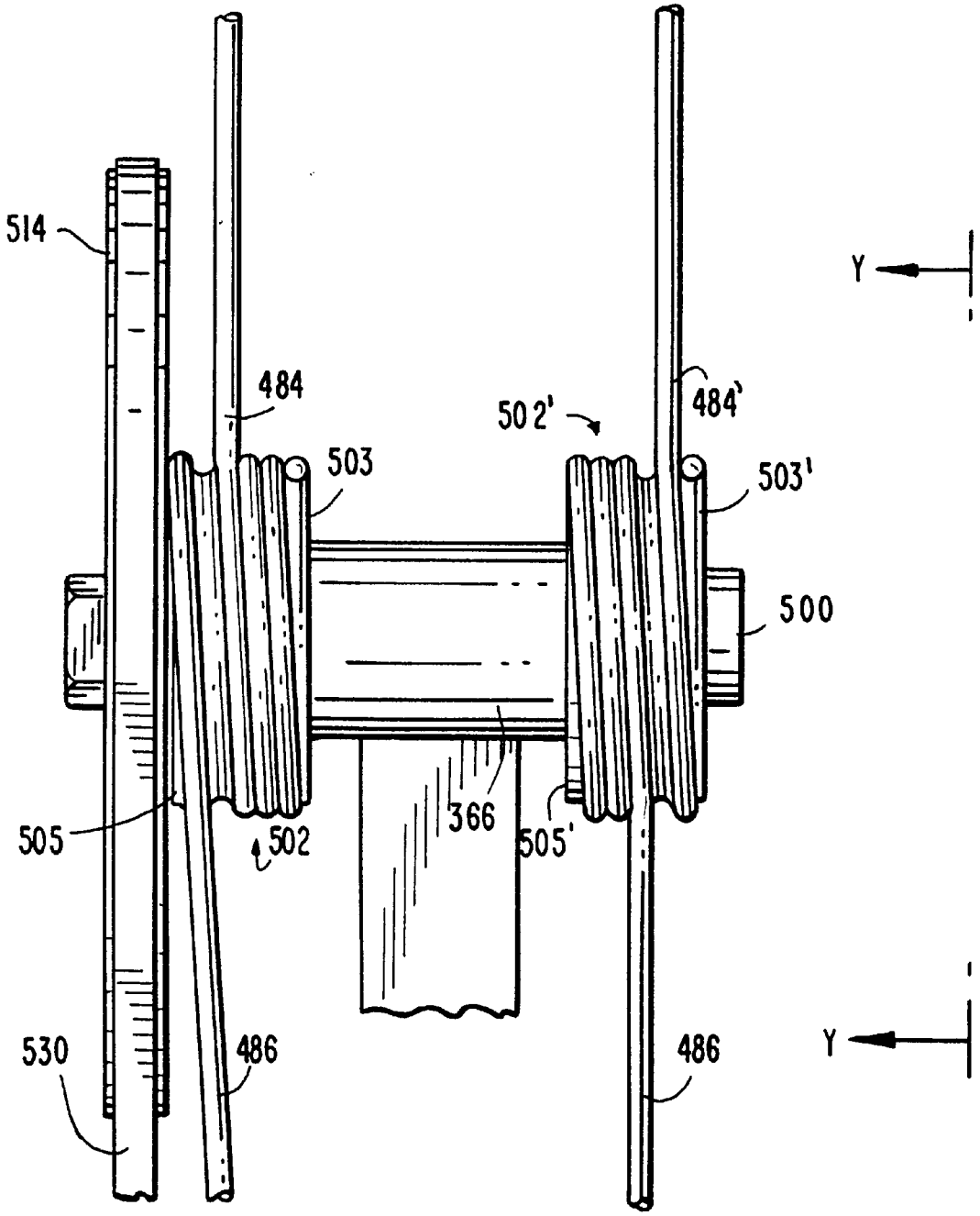
FIG. 17A is a partial front elevational view of the linkage and resistance mechanisms of another embodiment of the exercise apparatus of the present invention.
Figure 17B:
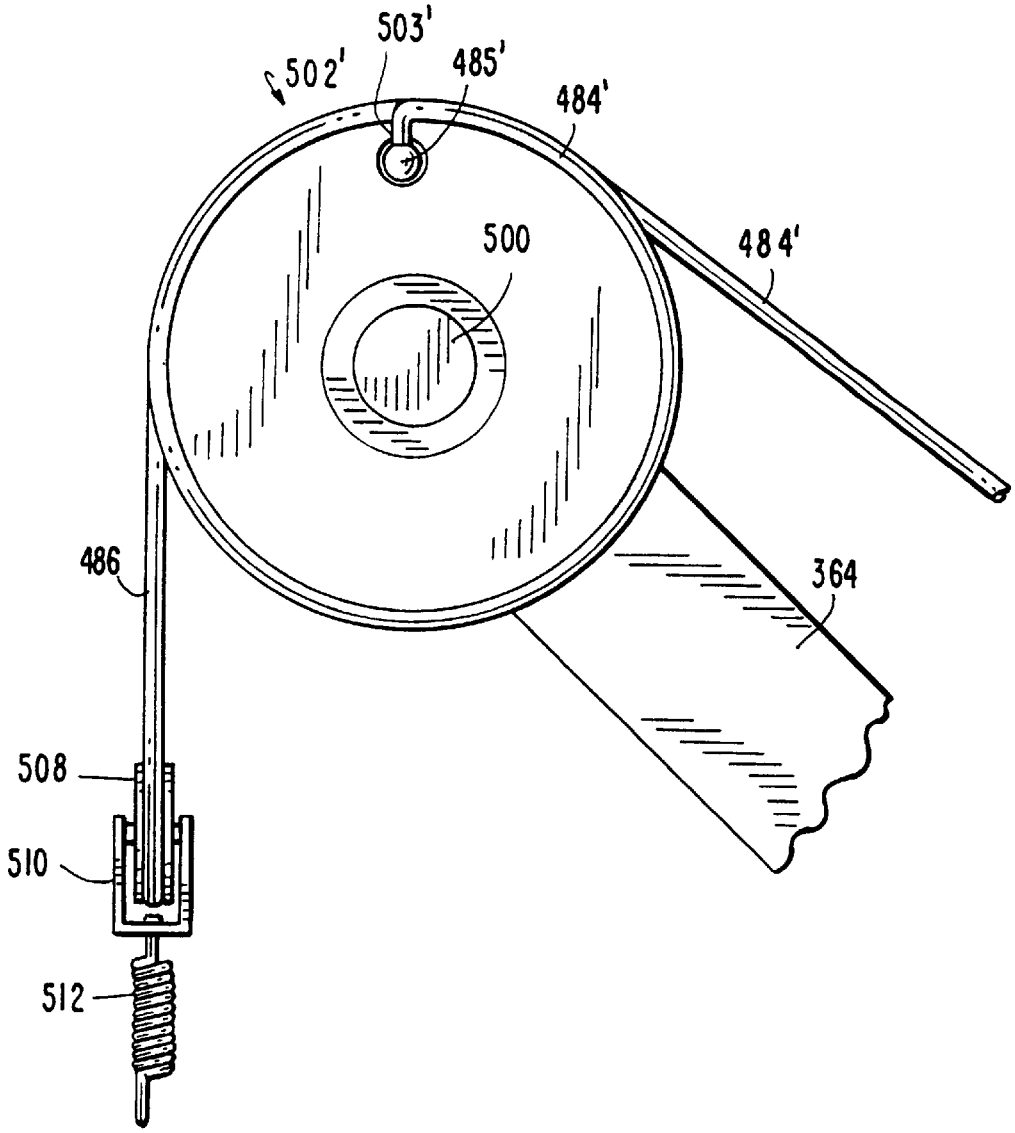
FIG. 17B is a partial side elevational view of the linkage and resistance mechanisms of FIG. 17A.

A twelfth embodiment is identical to the embodiment of FIGS. 16A–16C, except that the one piece cable 480 is replaced by three separate cable sections 484, 484' and 486. The routing of the three cable sections 484, 484' and 486 is the same as in the case of the single cable 480, however, referring to FIGS. 17A–17C, the cables are each secured to the helical pulleys 502/502' rather than being merely wrapped around them. Cables 484/484' are each connected at one end to the corresponding pedals 410/410' (FIG. 17C) and wrapped at least once around the corresponding helical pulley 502/502' (FIG. 17A). The other ends of cables 484/484' include ball ends 485/485' and are secured to the helical pulleys 502/502' at slots 503/503' (FIG. 17B). Cable 486 is similarly wrapped around and secured to each helical pulley 502/502' at slots 505/505'. The center section of cable 486 is journaled around cable return pulley 508 (FIG. 17B) as in the embodiment of FIGS. 16A–16C.

As shown in FIG. 17C, the cable 484 is secured to the pedal 410 by a cable mount assembly 422. The mount assembly 422 includes an elastomer tube 424 disposed within an elastomer socket 428 which is pivotally mounted to the front of the pedal 410. The pedal cable 484 extends through an aperture in the socket 428 and through the center of the elastomer tube 424. A ball end 485 at the end of cable 484 secures the cable 484 to the socket 428, and hence to the pedal 410, by engaging washer 426. This mounting arrangement absorbs some of the shock experienced at the point where the pedals change direction at the top of the stroke when the one-way clutch engages, thereby resulting in a softer feeling to the user.

It should be apparent from the drawings that the three cable arrangement functions the same as the single cable arrangement, however, wear on the three cables is less than in the single cable arrangement. The reduced wear is achieved because each individual cable section is permitted to rotate (twist) independent of the other sections. In addition, if one section should wear-out, only that section need be replaced rather than the entire cable assembly.

Figure 18A:
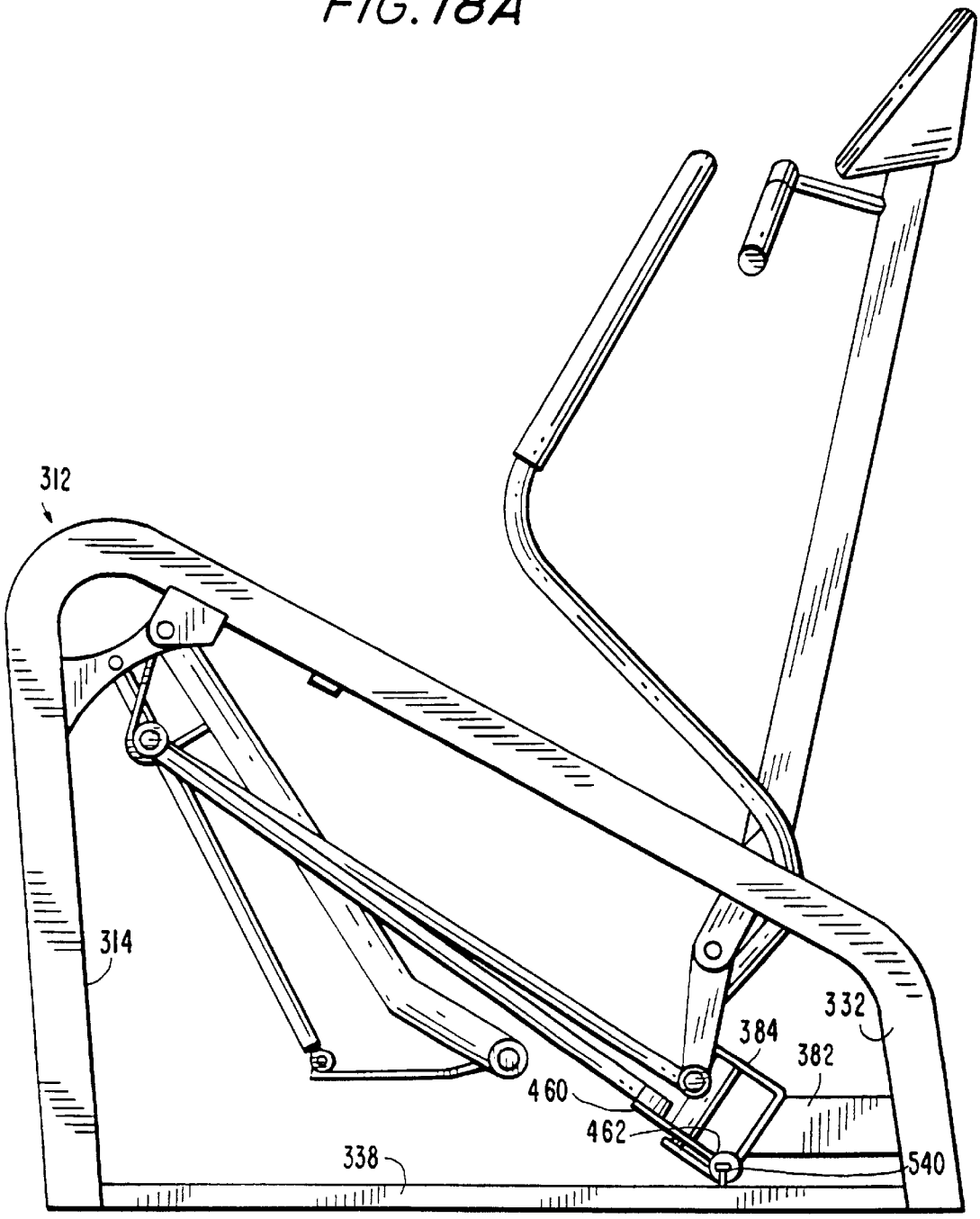
FIG. 18A is a side elevational view of another embodiment of the exercise apparatus of the present invention having a linear resistance and bell crank linkage.
Figure 18B:
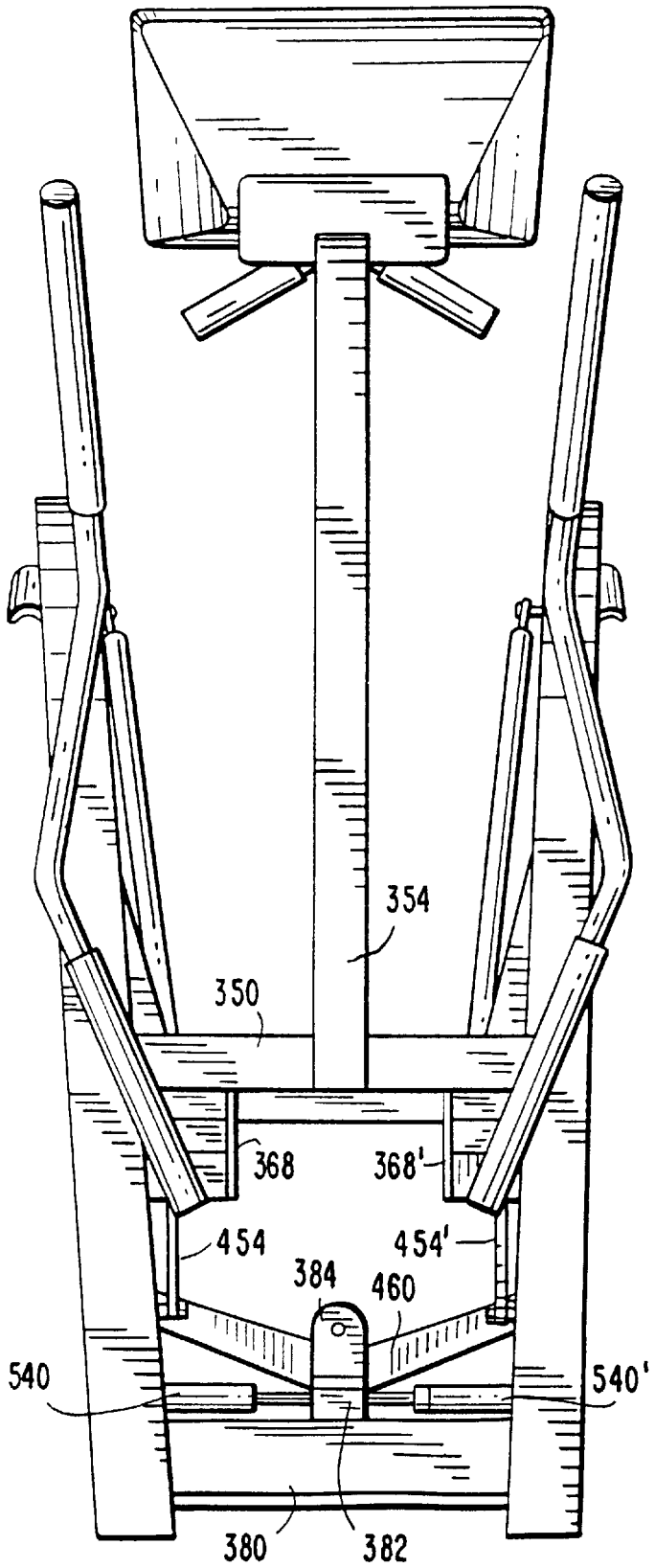
FIG. 18B a front view of the exercise apparatus of FIG. 17A.

FIGS. 18A and 18B show a thirteenth embodiment in which a hard linkage is used in conjunction with a linear resistance. The hard linkage uses a bell crank 460 in an identical manner to that described in conjunction with FIGS. 9–13. The bell crank 460 of this embodiment, however, includes an apex section 462 which extends in front of the bell crank pivot axis. A pair of shocks 540/540' are each mounted at one end to this apex section 462 in front of the bell crank pivot axis. The other end of each shock 540/540' is mounted to a respective base beam 338/338'. Each base beams 338/338', in turn, is mounted between the front leg portion 332/332' and the rear leg portion 314/314' of the respective side beam 312/312'. Thus, when the bell crank 460 is rocked back and forth on its axis by the connector links 430/430', the apex portion 462 of the bell crank 460 is reciprocated laterally. This causes the shocks 540/540' to alternately compress and expand 180° out of phase with one another, thereby providing a resistance to the movement of the bell crank 460.

The present invention has been described in terms of preferred embodiments thereof and the examples given are illustrative only. Other embodiments, features and variations within the scope of the appended claims will, given the benefit of this disclosure, occur to those having ordinary skill in the art. For example, components of the above embodiments may be mixed and combined while still practicing the present invention.

What is claimed is:

1. An exercise apparatus comprising:

a frame having a front and a rear;

a first arm pivotally mounted to said frame so as to pivot about a first pivot axis;

a first pedal mounted to said first arm distal to said first pivot axis;

a second arm pivotally mounted to said frame so as to pivot about a second pivot axis;

a second pedal mounted to said second arm distal to said second pivot axis; and a bell crank assembly operably connected to said arms such that when the arms are aligned, the first pedal is below and in front of the first pivot axis and the second pedal is below and in front of the second pivot axis.

2. The exercise apparatus of claim 1 wherein said bell crank assembly comprises:

a bell crank having a first side and a second side pivotally mounted to said frame;

a first connector link operably connected to said first arm and to the first side of said bell crank; and a second connector link operably connected to said second arm and to the second side of said bell crank.

3. An exercise apparatus comprising:

a frame having a front and a rear;

a first arm pivotally mounted to said frame so as to pivot about a first pivot axis;

a first pedal mounted to said first arm distal to said first pivot axis;

a second arm pivotally mounted to said frame so as to pivot about a second pivot axis, a second pedal mounted to said second arm distal to said second pivot axis;

a handle assembly mounted to the frame and disposed in front of said first and second pivot axes;

a linkage operably connecting said arms to one another such that when the arms are aligned, the first pedal is below and in front of the first pivot axis and the second pedal is below and in front of the second pivot axis;

means to resist pivoting of the arms, said resistance means comprising;

a shaft rotationally mounted to said frame;

a tether assembly operably connecting said pedals to said shaft such that pivoting of said arms causes rotation of said shaft, said tether assembly comprising;

a first one-way clutch mounted to said shaft;

a first pulley mounted to said first one-way clutch;

a second one-way clutch mounted to said shaft;

a second pulley mounted to said second one-way clutch; and tether means operably connecting said first pedal to said first pulley and operably connecting said second pedal to said second pulley; and means to resist rotation of said shaft.

4. The exercise apparatus of claim 3 wherein said tether means comprises:

a cable return pulley mounted to said frame; and a cable operably connected to said pedals and journaled around said cable return pulley.

5. The exercise apparatus of claim 4 wherein said cable return pulley is mounted to said frame by a biasing element.

6. The exercise apparatus of claim 5 further comprising a pulley stop mounted to said frame proximate said return pulley.

7. The exercise apparatus of claim 3 wherein said tether means comprises:

a first cable operably connected at a first end to said first pedal and connected at a second end to said first pulley; and a second cable operably connected at a first end to said second pedal and connected at a second end to said second pulley.

8. The exercise apparatus of claim 7 further comprising:

a cable return pulley mounted to said frame; and a third cable connected at a first end to said first pulley and connected at a second end to said second pulley, wherein said third cable is journaled around said cable return pulley.

9. The exercise apparatus of claim 8, wherein said cable return pulley is mounted to said frame by a biasing element.

10. The exercise apparatus of claim 9 further comprising a pulley stop mounted to said frame proximate said return pulley.

11. An exercise apparatus comprising:

a frame having a front and a rear;

a first arm pivotally mounted to said frame so as to pivot about a first pivot axis;

a first pedal mounted to said first arm distal to said first pivot axis;

a second arm pivotally mounted to said frame so as to pivot about a second pivot axis;

a second pedal mounted to said second arm distal to said second pivot axis;

a handle assembly mounted to the frame and disposed in front of said first and second pivot axes;

a linkage operably connecting said arms to one another such that when the arms are aligned, the first pedal is below and in front of the first pivot axis and the second pedal is below and in front of the second pivot axis;

means to resist pivoting of the arms, said resistance means comprising;

a shaft rotationally mounted to said frame;

means to operably connect said pedals to said shaft such that pivoting of said arms causes rotation of said shaft; and means to resist rotation of said shaft, said shaft rotation resistance means comprising;

a drive pulley mounted to said shaft;

an alternator mounted to said frame proximate said shaft; and a drive belt operably connecting said drive pulley and said alternator.

12. The apparatus of claim 11 further comprising means to maintain tension on said drive belt.

13. The apparatus of claim 12 wherein said belt tensioning means comprises:

a locking-hinge mounting bracket mounted to said frame; and a guide pulley mounted to said locking-hinge mounting bracket distal to said frame.

14. An exercise apparatus comprising:

a frame having a front and a rear;

a first main link pivotally mounted to the rear of said frame so as to pivot about a first pivot axis;

a first secondary link pivotally mounted to the rear of said frame proximate said first main link;

a first pedal pivotally mounted to said first main link and pivotally mounted to said first secondary link;

a second main link pivotally mounted to the rear of said frame so as to pivot about a second pivot axis;

a second secondary link pivotally mounted to the rear of said frame proximate said second main link;

a second pedal pivotally mounted to said second main link and pivotally mounted to said second secondary link;

a handle assembly mounted to the frame and disposed in front of said first and second pivot axes;

a linkage operably connecting said pedals to one another such that when the pedals are aligned, the first pedal is below and in front of the first pivot axis and the second pedal is below and in front of the second pivot axis;

a shaft rotationally mounted to said frame;

a tether assembly operably connecting said pedals to said shaft, said tether assembly comprising;

a first one-way clutch mounted to said shaft;

a first pulley mounted to said first one-way clutch;

a second one-way clutch mounted to said shaft;

a second pulley mounted to said second one-way clutch; and tether means operably connecting said first pedal to said first pulley and operably connecting said second pedal to said second pulley; and means to resist rotation of said shaft.

15. The exercise apparatus of claim 14 wherein said tether means comprises:

a cable return pulley mounted to said frame; and a cable assembly operably connected to said pedals and journaled around said first and second pulleys and said cable return pulley.

16. The exercise apparatus of claim 15 wherein said cable return pulley is mounted to said frame by a biasing element.

17. The exercise apparatus of claim 14 wherein said tether means comprises:

a first cable operably connected at a first end to said first pedal and connected at a second end to said first pulley; and a second cable operably connected at a first end to said second pedal and connected at a second end to said second pulley.

18. The exercise apparatus of claim 17 further comprising:

a first elastomer member mounted to said first pedal and operably connected to said first cable; and a second elastomer member mounted to said second pedal and operably connected to said second cable.

19. The exercise apparatus of claim 17 further comprising:

a cable return pulley mounted to said frame; and a third cable connected at a first end to said first pulley and connected at a second end to said second pulley, wherein said third cable is journaled around said cable return pulley.

20. The exercise apparatus of claim 19 wherein said cable return pulley is mounted to said frame by a biasing element.

21. An exercise apparatus comprising:

a frame having a front and a rear;

a first main link pivotally mounted to the rear of said frame so as to pivot about a first pivot axis;

a first secondary link pivotally mounted to the rear of said frame proximate said first main link;

a first pedal pivotally mounted to said first main link and pivotally mounted to said first secondary link;

a second main link pivotally mounted to the rear of said frame so as to pivot about a second pivot axis;

a second secondary link pivotally mounted to the rear of said frame proximate said second main link;

a second pedal pivotally mounted to said second main link and pivotally mounted to said second second arm link;

a handle assembly mounted to the frame and disposed in front of said first and second pivot axes;

a linkage operably connecting said pedals to one another such that when the pedals are aligned, the first pedal is below and in front of the first pivot axis and the second pedal is below and in front of the second pivot axis;

a shaft rotationally mounted to said frame;

a tether assembly operably connecting said pedals to said shaft, said tether assembly comprising; and means to resist rotation of said shaft, said shaft rotation resistance means comprising;

a drive pulley mounted to said shaft;

an alternator mounted to said frame proximate said shaft; and a drive belt operably connecting said drive pulley and said alternator.

22. The apparatus of claim 21 further comprising a guide pulley mounted to said frame by an automatic tensioning device.

23. An exercise apparatus comprising:

a frame having a front and a rear;

a first main link pivotally mounted to the rear of said frame so as to pivot about a first pivot axis;

a first secondary link pivotally mounted to the rear of said frame proximate said first main link;

a first pedal pivotally mounted to said first main link and pivotally mounted to said first secondary link;

a second main link pivotally mounted to the rear of said frame so as to pivot about a second pivot axis;

a second secondary link pivotally mounted to the rear of said frame proximate said second main link;

a second pedal pivotally mounted to said second main link and pivotally mounted to said second secondary link;

a handle assembly mounted to the frame and disposed in front of said first and second pivot axes; and a linkage operably connecting said pedals to one another such that when the pedals are aligned, the first pedal is below and in front of the first pivot axis and the second pedal is below and in front of the second pivot axis, said linkage comprising;

a bell crank pivotally mounted to said frame, said bell crank having a first side and a second side;

means for operably connecting said first side of said bell crank to said first pedal; and means for operably connecting said second side of said bell crank to said second pedal.

24. The exercise apparatus of claim 23 wherein said handle assembly comprises:

a first handle pivotally mounted to said frame;

a second handle pivotally mounted to said frame;

a first intermediate link operably connected to said first handle and to the first side of said bell crank; and a second intermediate link operably connected to said second handle and to the second side of said bell crank.

25. The exercise apparatus of claim 24 wherein said means for operably connecting said first and second sides of said bell crank to said first and second pedals comprises:

a first handle link operably connected to said first pedal and to said first handle; and a second handle link operably connected to said second pedal and to said second handle.

26. The exercise apparatus of claim 25 wherein said first intermediate link comprises a first flexible member and said second intermediate link comprises a second flexible member.

27. The exercise apparatus of claim 26 wherein said first intermediate link further comprises a first cable securing a first and second mounting bracket to said flexible member and wherein said second intermediate link further comprises a second cable securing a third and fourth mounting bracket to said second flexible member.

28. An exercise apparatus comprising:

a frame:

a first input arm for engaging a limb of a user pivotally mounted to the frame;

a second input arm for engaging a limb of a user pivotally mounted to the frame;

a shaft rotationally mounted to said frame;

a first one-way clutch mounted to said shaft;

a first pulley mounted to said first one-way clutch;

a second one-way, clutch mounted to said shaft;

a second pulley mounted to said second one-way clutch;

a first cable operably connected at a first end to said first arm and connected at a second end to said first pulley;

a second cable operably connected at a first end to said second arm and connected at a second end to said second pulley;

a cable return pulley mounted to said frame; and a third cable connected at a first end to said first pulley and connected at a second end to said second pulley, wherein said third cable is journaled around said cable return pulley, whereby rotation of said first pulley causes rotation of said second pulley.

29. The apparatus of claim 28 wherein said cable return pulley is mounted to said frame by a biasing element.

30. The apparatus of claim 29 further comprising a pulley stop mounted to said frame proximate said return pulley.

31. The apparatus of claim 28 further comprising means to resist rotation of said shaft.

32. The apparatus of claim 31 wherein said shaft rotation resistance means comprises:

a drive pulley mounted to said shaft;

an alternator mounted to said frame proximate said shaft; and a drive belt operably connecting said drive pulley and said alternator.

33. The exercise apparatus of claim 31 wherein said shaft rotation resistance means comprises a friction clutch operably connected to said shaft.

* * * * *